US012595708B2

(12) United States Patent
Murta et al.

(10) Patent No.: US 12,595,708 B2
(45) Date of Patent: Apr. 7, 2026

(54) CENTRALIZER FOR A TOOL IN A DRILL COLLAR

(71) Applicant: Nabors Drilling Technologies USA, Inc., Houston, TX (US)

(72) Inventors: Scott Murta, Exton, PA (US); Sergei Knizhnik, Exton, PA (US); Tom Mitchell, Wilmington, DE (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 18/642,065

(22) Filed: Apr. 22, 2024

(65) Prior Publication Data

US 2024/0360729 A1 Oct. 31, 2024

Related U.S. Application Data

(60) Provisional application No. 63/498,304, filed on Apr. 26, 2023.

(51) Int. Cl.
*E21B 17/10* (2006.01)

(52) U.S. Cl.
CPC ..... *E21B 17/1014* (2013.01)

(58) Field of Classification Search
CPC ..... E21B 17/1014
See application file for complete search history.

(56) References Cited

U.S. PATENT DOCUMENTS 3,837,412 A * 9/1974 Driver ..... E21B 25/10 175/104
4,425,966 A * 1/1984 Garney ..... G01V 11/005 166/241.5
4,790,381 A * 12/1988 Armell ..... E21B 17/1021 166/241.5
5,005,642 A * 4/1991 Moore ..... E21B 17/1021 166/241.5
5,265,684 A * 11/1993 Rosenhauch ..... E21B 17/1078 175/325.2
5,320,179 A 6/1994 Roos, Jr. et al.
5,358,039 A * 10/1994 Fordham ..... E21B 17/1021 166/241.1
5,396,966 A 3/1995 Roos, Jr. et al.
6,131,658 A * 10/2000 Minear ..... E21B 47/14 175/50

(Continued)

*Primary Examiner* — Neel Girish Patel
(74) *Attorney, Agent, or Firm* — Thorpe North & Western, LLP

(57) ABSTRACT

A system that can include a centralizer configured to be radially positioned between a tool and an internal bore of a tubular, wherein the centralizer is configured to engage the internal bore and the tool via a plurality of biasing devices circumferentially spaced away from each other about a center axis of the centralizer. A method can include installing a biasing device in a plurality of protrusions that extend radially outward, extending a portion of each biasing device past an outer radial surface of a respective protrusion to engage a tubular, and extending a portion of each biasing device past an inner radial surface of a central bore of the centralizer to engage a tool, where the first portion and the second portion are configured to substantially align a center axis of the tool with a center axis of the tubular when the tool is installed in the tubular.

11 Claims, 18 Drawing Sheets

(56) References Cited

U.S. PATENT DOCUMENTS 6,577,244 B1* 6/2003 Clark ..... G01V 11/002 340/854.6
8,844,624 B2 9/2014 Buytaert et al.
9,657,537 B2 5/2017 Riley et al.
10,358,906 B2 7/2019 Logan et al.
10,988,991 B1* 4/2021 McCormick ..... E21B 17/1021
11,136,880 B1* 10/2021 McCormick ..... E21B 47/017
12,116,850 B1* 10/2024 McCormick ..... E21B 17/1078
2002/0056201 A1* 5/2002 Dallas ..... E21B 47/022 33/313
2005/0098353 A1* 5/2005 Maxwell ..... E21B 17/1057 175/57
2008/0149394 A1* 6/2008 Downton ..... E21B 17/1014 175/73
2008/0283253 A1* 11/2008 Buytaert ..... E21B 17/1028 166/381
2009/0223717 A1* 9/2009 Eppink ..... E21B 17/1014 175/25
2014/0083773 A1* 3/2014 Minosyan ..... E21B 47/00 175/40
2014/0209389 A1* 7/2014 Sugiura ..... E21B 7/067 175/73
2016/0061776 A1* 3/2016 Aslanyan ..... E21B 17/1028 324/339
2016/0356099 A1* 12/2016 Kirkhope ..... E21B 4/16
2017/0183921 A1* 6/2017 Dockweiler ..... E21B 17/1078
2018/0003027 A1* 1/2018 Donzier ..... E21B 47/10
2018/0230779 A1* 8/2018 Bridges ..... E21B 47/26
2018/0298699 A1* 10/2018 Kartha ..... E21B 17/1021
2019/0242188 A1* 8/2019 Khandekar ..... E21B 10/325
2019/0383108 A1* 12/2019 Massey ..... E21B 47/092
2020/0011751 A1* 1/2020 Kazemi Miraki .... E21B 47/024
2020/0149358 A1* 5/2020 Robichaux ..... E21B 17/1078
2021/0025246 A1* 1/2021 Ford ..... E21B 43/127
2021/0102429 A1* 4/2021 Mohon ..... E21B 17/1014
2022/0049564 A1* 2/2022 Zeng ..... E21B 23/08
2022/0066066 A1* 3/2022 Zeghlache ..... G01V 1/52
2022/0275692 A1* 9/2022 Al-Mousa ..... E21B 41/0085
2024/0360729 A1* 10/2024 Murta ..... E21B 17/1078

* cited by examiner

Cross-section line 6-6

Cross-section line 7-7

Cross-section line 7-7

Cross-section line 10B-10B

CENTRALIZER FOR A TOOL IN A DRILL COLLAR

CROSS-REFERENCE TO RELATED APPLICATION(S)

This application claims priority under 35 U.S.C. § 119(e) to U.S. Provisional Application No. 63/498,304, entitled "CENTRALIZER FOR A TOOL IN A DRILL COLLAR," by Scott MURTA, filed Apr. 26, 2023, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for centralizing a tool in a drill collar during subterranean operations.

BACKGROUND

During a drilling operation, a bottom hole assembly (BHA) can be connected at an end of a drill string for extending a wellbore further into a subterranean formation. The BHA can include a drill bit at its lower end that can be driven by a mud motor, such as for slide drilling or directional drilling. Above the mud motor, the BHA can include one or more drill collars that can each contain one or more tools (e.g., as logging tools, telemetry tools, etc.). The tools can be used to detect parameters of the wellbore, the surrounding environment (including the surrounding formation), and the drill string, and then communicate these parameters to the surface for processing. The tools can transmit parameter information during drilling operations to support Logging While Drilling (LWD) or Measuring While Drilling (MWD) operations. Some tools may use electromagnetic (EM) telemetry or mud pulse telemetry for communicating the parameters to the surface. Assembling a BHA can require installing one or more tools in one or more drill collars. Securing one or more tools in the drill collars can improve a life span of the tools by reducing damage to the tools during the subterranean operations. Therefore, improvements in securing Logging While Drilling (LWD) or Measuring While Drilling (MWD) tools for performing LWD/MWD operations are continually needed.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

One general aspect includes a system for a subterranean operation. The system also includes a centralizer configured to be radially positioned between a tool and an internal bore of a tubular, where the centralizer is configured to engage the internal bore and the tool via each one of a plurality of biasing devices disposed within a respective one of a plurality of protrusions circumferentially spaced away from each other about a center axis of the centralizer.

One general aspect includes a method of centralizing a tool within a tubular for a subterranean operation. The method also includes installing a biasing device in each one of a plurality of protrusions of a centralizer, where the plurality of protrusions extend radially outward from a body; extending a first portion of each one of the biasing devices radially outward past an outer radial surface of a respective one of the plurality of protrusions, where the first portions are configured to engage an internal surface of a tubular; and extending a second portion of each one of the biasing devices radially inward past an inner radial surface of a central bore in the body of the centralizer, where the second portions are configured to engage an outer surface of a tool, and where the first portions and the second portions are configured to substantially align a center axis of the tool with a center axis of the tubular when the tool is installed in the tubular.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "substantially" or "generally" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," "casing string," "coiled tubing", or "wireline."

Figure 1:
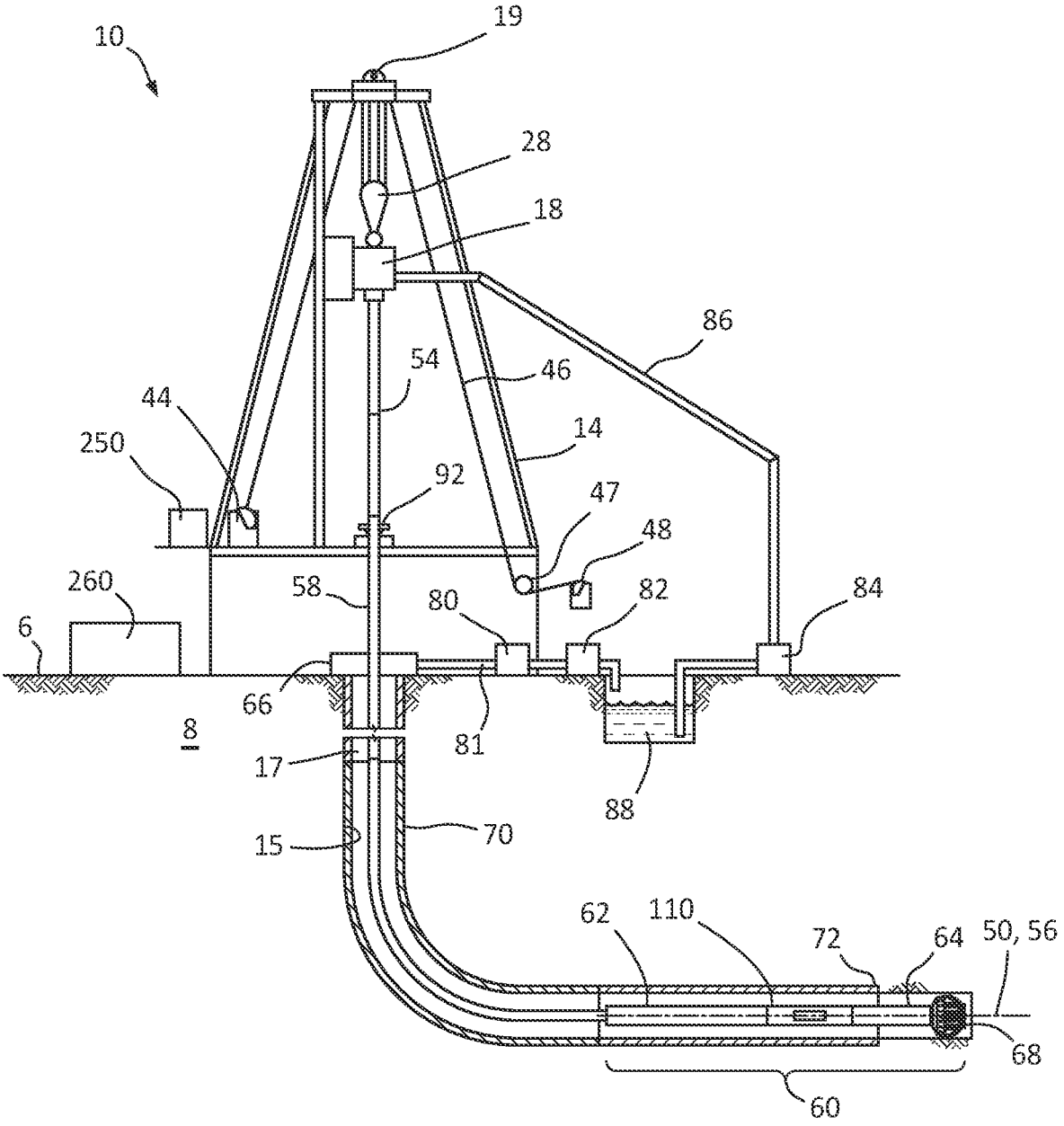
FIG. 1 is a representative simplified partial cross-section front view of a rig being utilized for a subterranean operation, in accordance with certain embodiments.

FIG. 1 is a representative partial cross-sectional front view of a rig 10 being used to drill a wellbore 15 in a subterranean formation 8. FIG. 1 shows a land-based rig, but the principles of this disclosure can equally apply to off-shore rigs, as well, where "off-shore" refers to a rig with water between the rig floor and the earth surface 6. Rig 10 can include a top drive 18 with a drawworks 44, sheaves 19, traveling block 28, anchor 47, and reel 48 used to raise or lower the top drive 18 via cable 46. A derrick 14 extending from the rig floor, can provide the structural support of the rig equipment for performing subterranean operations (e.g., drilling, treating, completing, producing, testing, etc.). The rig can be used to extend a wellbore 15 through the subterranean formation 8 by using a drill string 58 having a Bottom Hole Assembly (BHA) 60 at its lower end. The BHA 60 can include a drill bit 68 and multiple drill collars 62, with one or more of the drill collars including a tool 110 for Logging While Drilling (LWD) or Measuring While Drilling (MWD) operations. During drilling operations, drilling mud can be pumped from the surface 6 into the drill string 58 (e.g., via pumps 84 supplying mud to the top drive 18 via the standpipe 86) to cool and lubricate the drill bit 68 and to transport cuttings to the surface via an annulus 17 between the drill string 58 and the wellbore 15.

The returned mud can be directed to the mud pit 88 from a rotating control device 66, through the flow line 81, to the shaker 80. A fluid treatment 82 can inject additives as desired to the mud to condition the mud appropriately for the current well activities and possibly future well activities as the mud is being pumped to the mud pit 88. Pump 84 can pull mud from the mud pit 88 and drive it to the top drive 18, via standpipe 86, to continue circulation of the mud through the drill string 58.

The tubular string 58 can extend into the wellbore 15, with the wellbore 15 extending through the surface 6 into the subterranean formation 8. With a segmented tubular string 58, when tripping the tubular string 58 into the wellbore 15, tubulars 54 are sequentially added to the tubular string 58, e.g., via a top drive 18 and slips 92 that corporate together to extend the length of the tubular string 58 into the subterranean formation 8. When the tubular string 58 is a wireline or coiled tubing, the tubular string 58 can be uncoiled from a spool and extended into the wellbore 15. With a segmented tubular string 58, when tripping the tubular string 58 out of the wellbore 15, tubulars 54 are sequentially removed from the tubular string 58 to reduce the length of the tubular string 58 extending into the subterranean formation 8. With a wireline or coiled tubing, the tubular string 58 can be coiled onto a spool when being pulled out of the wellbore 15.

The wellbore 15 can have casing string 70 installed in the wellbore 15 and extending down to a casing shoe 72. The portion of the wellbore 15 with the casing string 70 installed, can be referred to as a cased wellbore. The portion of the wellbore 15 below the shoe 72, without casing, can be referred to as an "uncased" or "open hole" wellbore.

A rig controller 250 can be used to control rig 10 operations including controlling various rig equipment, such as a pipe handler, the top drive 18, an iron roughneck, fingerboard equipment, imaging systems, various other robots on the rig 10 (e.g., a drill floor robot), or rig power systems 260. The rig controller 250 can control the rig equipment autonomously (e.g., without periodic operator interaction), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation).

The rig controller 250 can include one or more processors with one or more of the processors distributed about the rig 10, such as in an operator's control hut, in a pipe handler, in an iron roughneck, in a vertical storage area, in the imaging systems, in various other robots, in the top drive 18, at various locations on the rig floor 16 or the derrick 14 or the platform 12, at a remote location off of the rig 10, at downhole locations, etc. It should be understood that any of these processors can perform control or calculations locally or can communicate to a remotely located processor for performing the control or calculations. Each of the processors can be communicatively coupled to a non-transitory memory, which can include instructions for the respective processor to read and execute to implement the desired control functions or other methods described in this disclosure. These processors can be coupled via a wired or wireless network.

The rig controller 250 can collect data from various data sources around the rig and downhole (e.g., sensor data via mud pulse telemetry, EM telemetry, etc.) and from remote data sources (e.g., suppliers, manufacturers, transporters, company men, remote rig reports, etc.) to monitor and facilitate the execution of the subterranean operation.

During subterranean operations, such as drilling, various logging operations are generally performed to collect and store sensor data for later processing to provide visualization of parameters and characteristics of the wellbore and its surroundings. The processing can be performed by the rig controller 250 during the subterranean operation or after the subterranean operation is complete. A tool 110 can be included in the BHA 60 (or otherwise included in the tubular string 58) for performing logging or measuring operations at various times during the operation, or during the operation. Tool 110 can have a longitudinal center axis 56, which can also correspond to the longitudinal center axis 50 of an internal bore of the BHA 60 (or tubular 54). Some of the logging/measuring operations can be to collect downhole sensor data of the wellbore 15 while the tubular string 58 is being rotated (such as for drilling, reaming, etc.). The downhole sensor data can be communicated to the surface via various telemetry methods that can be detected at the surface and decoded to retrieve the sensor data.

Figure 2:
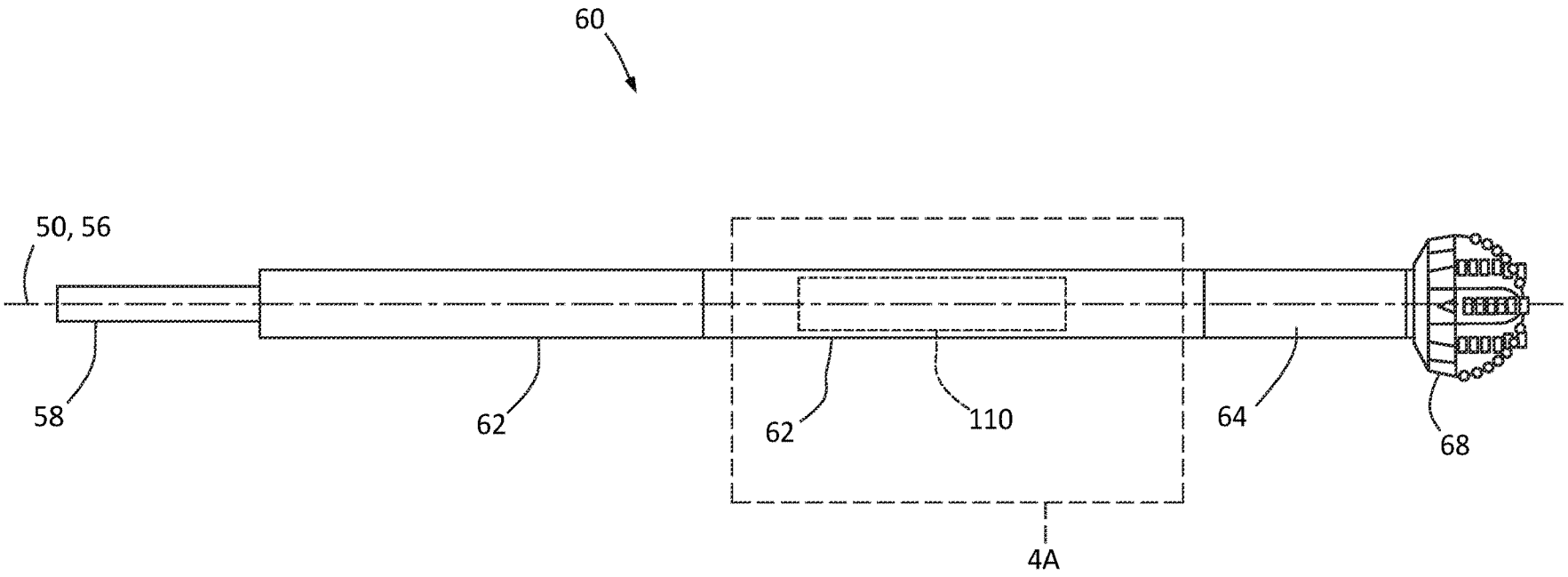
FIG. 2 is a representative simplified side view of a BHA with at least one tool contained within a drill collar, in accordance with certain embodiments.

FIG. 2 is a representative simplified side view of a BHA 60 with at least one tool 110 contained within a drill collar 62, according to certain embodiments. The BHA 60 can include a drill bit 68 at the bottom end with a mud motor 64 for rotating the drill bit 68 during slide drilling or directional drilling operations. One or more drill collars 62 can be attached to the mud motor 64 or the drill bit 68 (if a mud motor 64 is not utilized), with one or more of the drill collars containing a tool 110 and possibly connected to a lower end of the tubular string 58. It should be understood that the tool 110 can also be installed in a tubular 54 that is not part of a BHA, such as when a tool 110 is needed in other parts of the tubular string 58.

The tool 110 can be used to generate sensor data representative of a toolface of the tool 110, the inclination of the tool 110, the azimuthal orientation of the tool 110, the amount of gamma radiation being detected by the tool 110, parameters of the surrounding formation, pressure or temperature sensed by the tool 110, forces acting on the tool 110 or tubular string 58, and any other parameter sensed by the tool 110, and then transmitting a representation of the sensed data via an appropriate telemetry to the surface for further processing.

Figure 3:
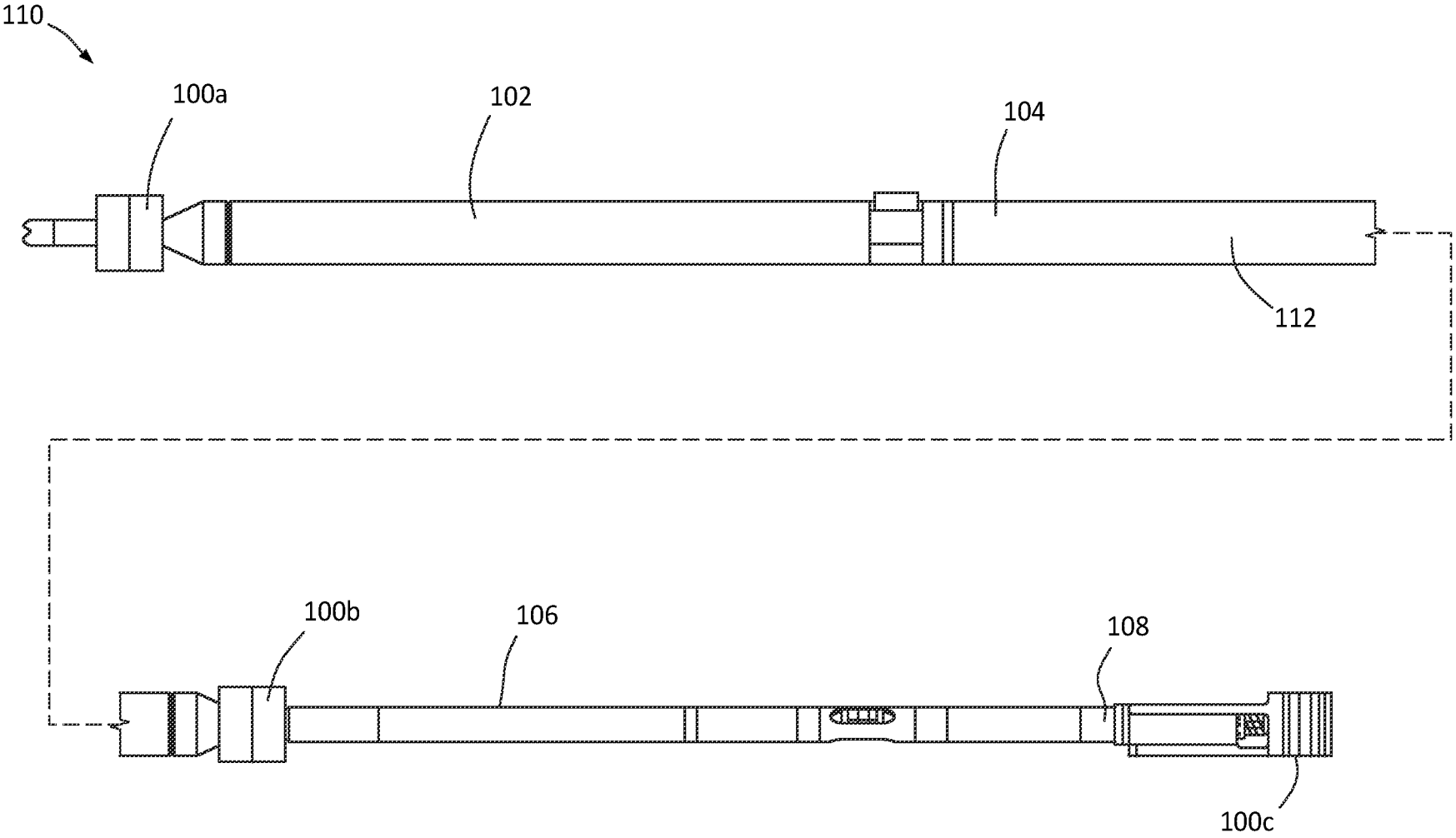
FIG. 3 is a representative side view of an example tool shown outside of a drill collar, in accordance with certain embodiments.

FIG. 3 is a representative perspective side view of an example tool 110 shown outside of a drill collar 62, in accordance with certain embodiments, such as before the tool 110 is installed in the drill collar 62 (or tubular 54). In a certain embodiment, the tool 110 can include a battery stack 102 for powering the tool 110 with an electronics package 104 installed between the battery stack 102 and the pulser 106. The lower end 108 can be used to seat the tool 110 in the drill collar 62 by engaging the lower end centralizer 100*c* with the inner surface 69 of an internal bore of the drill collar 62. Centralizers 100*a*, 100*b* can also be utilized to center the tool 110 in a drill collar 62. Various embodiments of a centralizer 100 are described in more detail below.

Figure 4A:
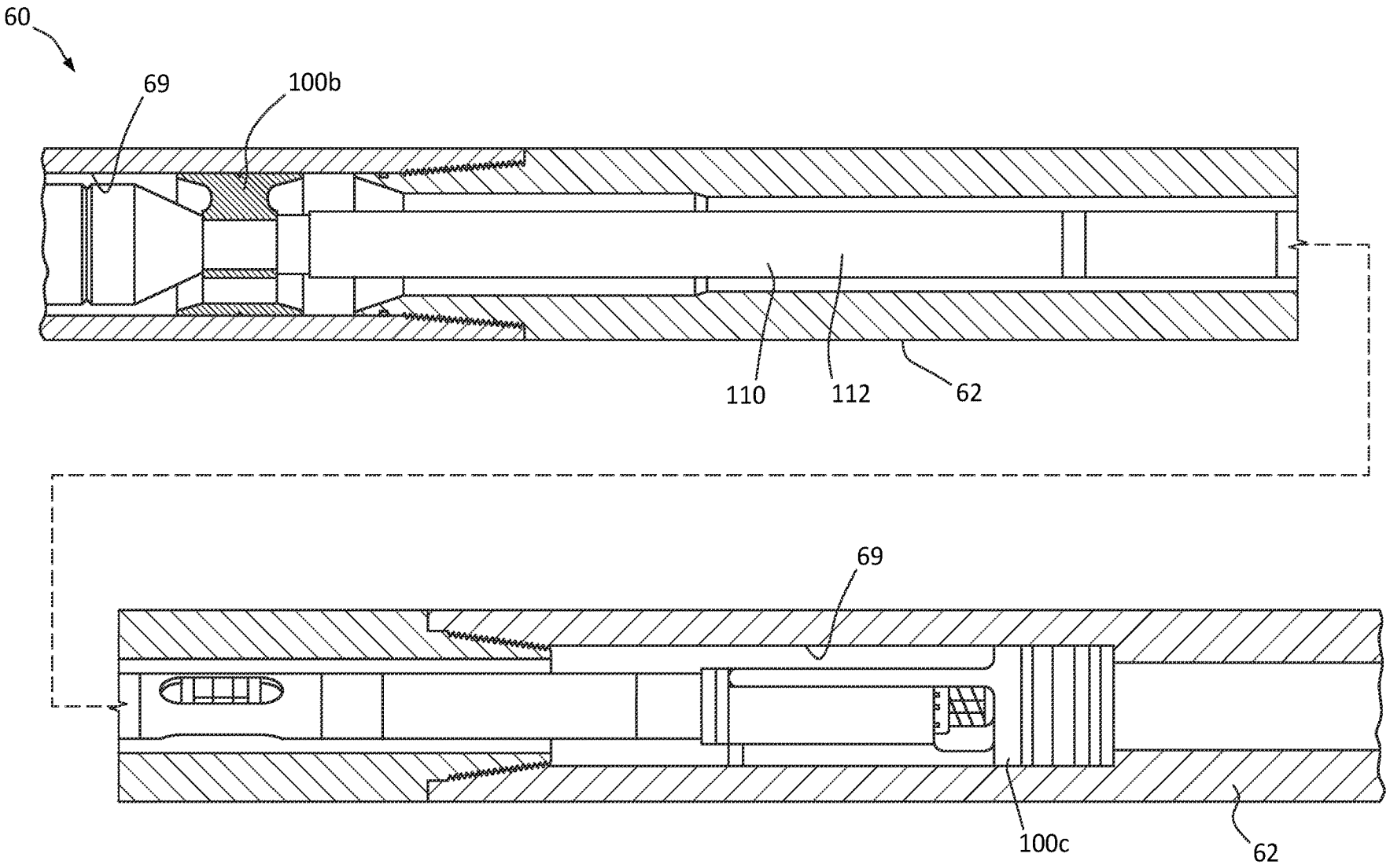
FIG. 4A is a representative partial cross-sectional side view, of a tool disposed in a drill collar, in accordance with certain embodiments.

FIG. 4A is a representative partial cross-sectional view of a tool 110 disposed in a drill collar 62, in accordance with certain embodiments. FIG. 4A is a detailed view of the area shown in FIG. 2. This shows how the tool 110 can be installed in a drill collar 62 for assembly in a BHA 60 using one or more centralizers 100 (e.g., centralizers 100*b*, 100*c*).

Figure 4B:
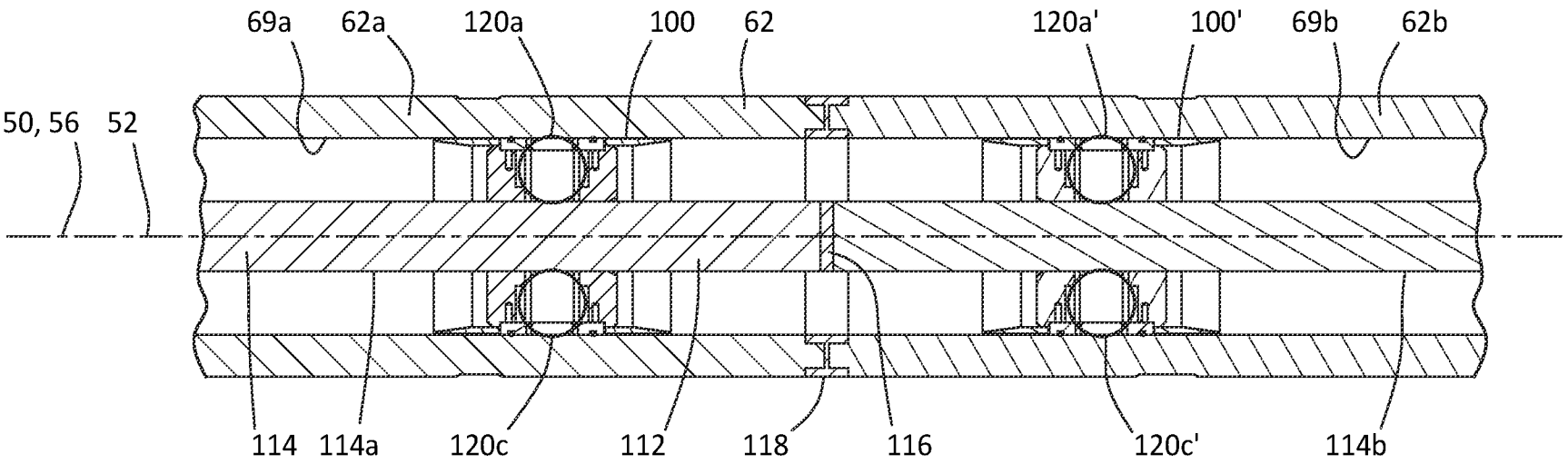
FIG. 4B is a representative partial cross-sectional side view, of another tool disposed in a drill collar, in accordance with certain embodiments.

FIG. 4B is a representative partial cross-sectional view, of another tool 110 disposed in a drill collar 62, in accordance with certain embodiments. The portion of a BHA 60 shown in FIG. 4B can be used for EM telemetry by electrically isolating upper and lower segments 62*a*, 62*b* of the drill collar 62 and varying a voltage potential between them to create an EM signal that can be transmitted to a receiver using EM telemetry. An insulating spacer 118 can be disposed between the upper segment 62*a* and the lower segment 62*b* to electrically isolate the upper and lower segments 62*a*, 62*b*.

The tool 110 can be a probe 114 for varying the voltage potential between the upper and lower segments 62*a*, 62*b*. The probe 114 can have a body 112 that can include an upper portion 114*a* and a lower portion 114*b*, with an insulating spacer 116 disposed therebetween to electrically isolate the upper and lower portions 114*a*, 114*b*. The probe 114 can be installed through a center bore (or lumen) of the centralizers 100, 100', and the centralizers 100, 100' can be installed in a drill collar 62.

The upper portion 114*a* can be positioned within the centralizer 100 with the lower portion 114*b* positioned within the centralizer 100'. The centralizer 100 can provide a plurality of biasing devices (e.g., 120*a*, 120*c*) that can engage the upper portion 114*a* and an inner surface 69*a* of the upper segment 62*a*. The centralizer 100' can provide a plurality of biasing devices (e.g., 120*a*', 120*c*') that can engage an inner surface 69*b* of the lower segment 62*b* and a lower portion 114*b* of the probe 114.

The biasing device(s) 120*a*, 120*c*, 120*a*', 120*c*' can urge the probe 114 away from the inner surfaces 69*a*, 69*b*. Since the biasing devices can all apply a radially inward biasing force to the probe 114, the biasing devices tend to centralize the probe in the drill collar 62 such that the center axis 52 of the centralizers 100, 100' are generally aligned with the center axis 50 of the internal bore of the BHA 60, due to the radial positioning of the biasing devices around the probe 114 within the drill collar 62.

It should be understood, the biasing devices can be electrically non-conductive (or electrically insulating). However, the biasing devices can also be electrically conductive (or electrically non-insulating), as can be the case for the configuration shown in FIG. 4B, where the probe 114 and the drill collar 62 can be used to create EM telemetry signals. In this configuration, or similar configurations, the biasing devices 120*a*, 120*c*, 120*a*', 120*c*' can be electrically conductive to transfer electrical energy between the upper portion 114*a* and the upper segment 62*a* and independently (due to the insulating spacers 116, 118) transfer electrical energy between the lower portion 114*b* and the lower segment 62*b*. The electrical energy supplied to the upper and lower portions 114*a*, 114*b* of the probe 114 can be controlled to create a voltage potential between the upper and lower portions 114*a*, 114*b*, and thus create a voltage between the upper and lower segments 62*a*, 62*b* due to the electrical conductivity of biasing devices 120*a*, 120*c*, 120*a*', 120*c*'. Additionally, or in the alternative, the insert 150 (see FIG. 5) can be manufactured from either electrically conductive material or electrically non-conductive material.

It should be understood that the biasing devices 120 (and the protrusions 156) can be spaced radially about a centralizer 100, 100' at desired distances. For example, the biasing devices 120 can include biasing devices 120*a*, 120*c* (shown) and 120*b*, 120*d* (not shown) each spaced approximately 90 degrees (see angle A1 in FIG. 6) from each adjacent neighbor for any centralizer 100 (including centralizer 100'). For example, the biasing devices 120 can also be spaced approximately 60 degrees, or 45 degrees, or 30 degrees, or 15 degrees, or combinations thereof from adjacent neighbors for any centralizer 100 (including centralizer 100'). The angle A1 between an adjacent pair of biasing devices 120 (or protrusions 156) can be different than an angle A1 between another adjacent pair of biasing devices 120 (or protrusions 156).

Figure 5:
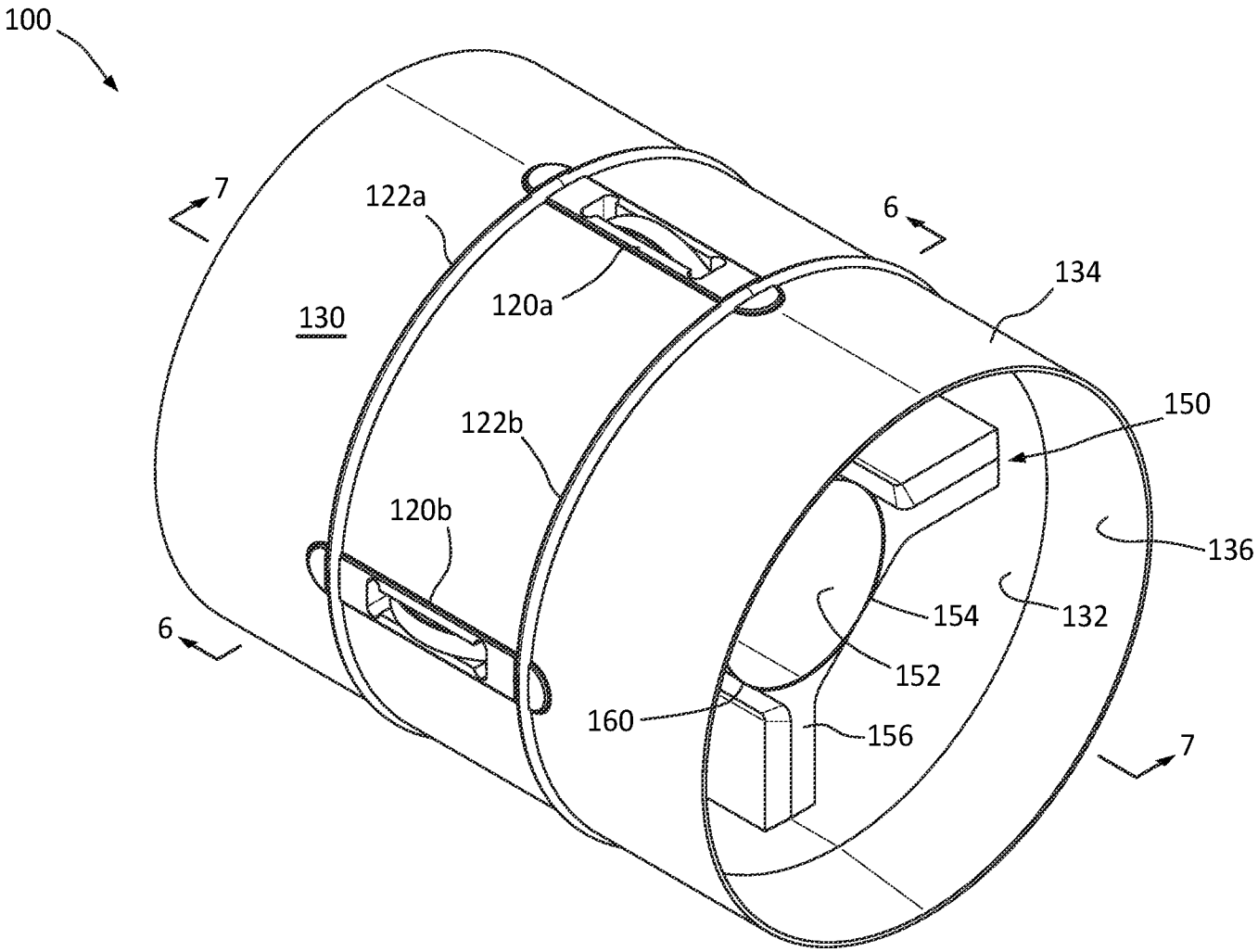
FIG. 5 is a representative perspective view of a centralizer for a tool in a drill collar, in accordance with certain embodiments.

FIG. 5 is a representative perspective view of a centralizer 100 for a tool 110 in a drill collar 62 (or tubular 54), in accordance with certain embodiments. The centralizer 100 can include an insert 150 positioned within a sleeve 130. The insert 150 can include a plurality of protrusions 156, such as 3, 4, 5, 6, 7, 8, 9, 10, 11, or 12 protrusions, that extend radially from a body 160 of the insert 150. A biasing device 120 (e.g., biasing devices 120*a*, 120*b*, etc.) can be disposed in each of the protrusions 156 and can be held in the protrusions 156 via retention features, such as bands 122*a*, 122*b* or fasteners (not shown).

The biasing devices 120 can engage an outer surface of the tool 110 and an inner surface of the internal bore of the drill collar 62 to provide a distributed centralizing force acting on the tool 110. This distributed centralizing force urges the tool 110 to be substantially centralized within a generally cylindrical inner surface of the internal bore of the drill collar 62.

In a non-limiting embodiment, the biasing devices 120 can provide an electrical coupling between the inner surface of the internal bore of the drill collar 62 and the outer surface of the tool 110, such as described above in FIG. 4B for EM telemetry, but can also be used for other purposes, such as grounding the tool 110 via the electrical coupling to the drill collar 62.

In a non-limiting embodiment, the biasing devices 120 can provide vibration dampening between the drill collar 62 and the tool 110, even when the biasing devices 120 do not provide electrical coupling between the drill collar 62 and the tool 110. The vibration dampening can be very beneficial to extending the useful life of the tool 110 by reducing exposure to damaging vibrations of the BHA during operation.

In a non-limiting embodiment, the biasing devices 120 can provide a known distributed centralizing force on the tool 110 when the tool 110 is installed in centralizer 100 in the drill collar 62. The biasing devices 120 can allow the centralizer 100 to maintain (at least partially around the drill collar 62) a gap between the outer surface of the centralizer 100 (excluding biasing elements 170 of the biasing devices 120) and the inner surface of the internal bore of the drill collar 62. This gap can help to vibrationally isolate (or at least partially isolate) the tool 110 from the drill collar 62, as well as allow larger manufacturing tolerances of the inner surface of the drill collar 62. Standard centralizers currently require close tolerances of the outer surface or outer diameter of the standard centralizer as well as close tolerances of the inner surface or inner diameter of the drill collar 62 for ensuring centralization of the tool 110 and reducing damage to the tool 110 due to vibration of the drill collar 62. Looser tolerances can tend to allow the centralizer and thus the tool 110 to rattle around inside the drill collar 62, which can exacerbate vibration damage to the tool 110 by impacts of the centralizer and the drill collar 62.

These closer tolerances allow defects or concentricity problems of the drill collar 62 or the standard centralizer to cause many other problems when installing or removing the tool 110 into or from the drill collar 62. However, by using the biasing devices 120, the manufacturing tolerances for the centralizer 100, the drill collar 62, and the tool 110 can be relaxed since a larger gap between the centralizer 100 and the drill collar 62 can be allowed. By allowing a larger gap between the centralizer 100 and the drill collar 62, the tool 110 can be more consistently and reliably installed into or removed from the drill collar 62 without causing clearance issues.

It should be understood that the centralizer 100 can be used without the biasing devices 120, but it is preferred that the centralizer 100 include the biasing devices 120. If the biasing devices 120 are not used, then the manufacturing tolerances of the centralizer 100, tool 110, and drill collar 62 may need to be tighter than when using the biasing devices 120.

Figure 6:
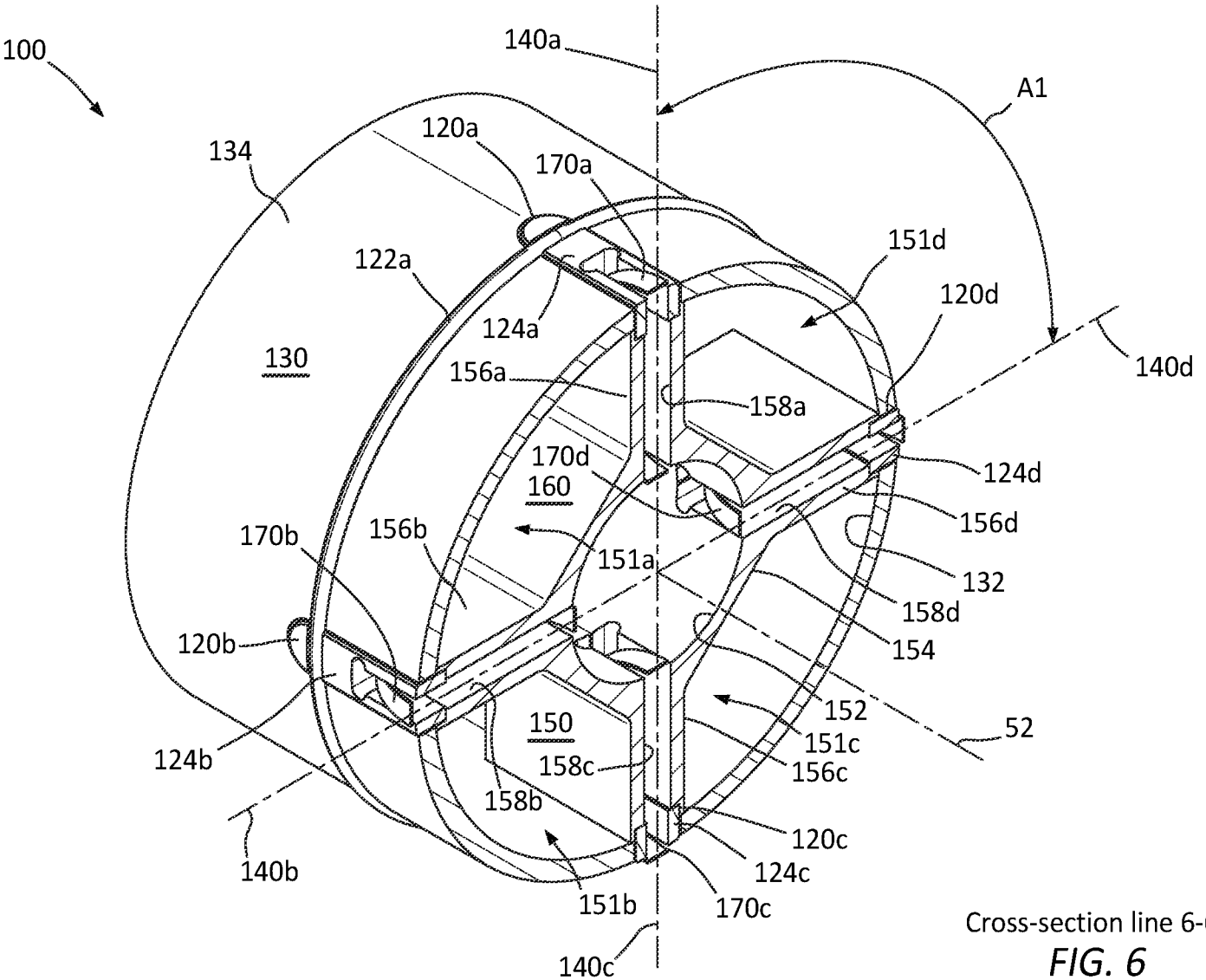
FIG. 6 is a representative partial cross-sectional perspective view along line 6-6, as indicated in FIG. 5, of a centralizer for a tool in a drill collar, in accordance with certain embodiments.

FIG. 6 is a representative partial cross-sectional perspective view 6-6, as indicated in FIG. 5, of a centralizer 100 for a tool 110 in a drill collar 62, in accordance with certain embodiments. In a non-limiting embodiment, the centralizer 100 is shown with a sleeve 130 and an insert 150 positioned in the sleeve 130. The insert 150 can have multiple protrusions (e.g., protrusions 156*a-d*) that extend radially outward from a center body 160. The center body 160 can have an internal bore 152 that extends longitudinally through the center body 160 of the insert 150 along a center axis 52 of the centralizer 100. A center axis 52 of bore 152 can align with a center axis 50 of the internal bore of the BHA 60 (or drill collar 62) when the centralizer 100 is installed in the BHA 60. However, it is not required that the center axis 52 of bore 152 be aligned with the center axis 50 of the internal bore of the BHA 60 (or drill collar 62).

Each of the protrusions 156*a-d* can include a respective channel 158*a-d* extending radially therethrough. Each of the channels 158*a-d* can include a varied profile which can be used to receive and retain respective biasing elements 170*a-d* in the respective channels 158*a-d*. Once the biasing elements 170*a-d* are installed in their respective channels 158*a-d*, retention elements 124*a-d* can be installed to the respective channels 158*a-d* and used to retain the respective biasing elements 170*a-d* in their respective channels 158*a-d*.

If a sleeve 130 is used, as in this embodiment, then the insert 150 may be installed in the sleeve 130 prior to the installation of the biasing elements 170*a-d* and retention elements 124*a-d* in their respective channels 158*a-d*. The retention elements 124*a-d* can be removably attached to the respective protrusions 156*a-d* via retention bands 122*a-b* (see FIG. 5). The retention bands 122*a-b* can be O-rings that provide sealing engagement between the sleeve 130 and an inner surface 69 of the internal bore of the drill collar 62. However, it is not required that the retention bands 122*a-b* sealingly engage the inner surface 69 of the internal bore of the drill collar 62. The retention bands 122*a-b* can be positioned in annular grooves in an outer surface 134 of the sleeve 130. Alternatively, or in addition to, the retention elements 124*a-d* can be removably attached to the respective protrusions 156*a-d* via fasteners 128*a-d*, such as in at least FIGS. 8C-8D for the biasing device 120*c*.

The multiple protrusions 156 can be positioned circumferentially around the center body 160 at an angle A1 from their adjacent neighbor. The protrusions 156 (and thus the biasing devices 120) can each be spaced approximately 90 degrees (as shown in FIG. 6) from each adjacent neighbor for any centralizer 100. However, the biasing devices 120 can also be spaced approximately 60 degrees, or 45 degrees, or 30 degrees, or 15 degrees, or combinations thereof from adjacent neighbors for any centralizer 100. Additionally, the angle A1 between an adjacent pair of biasing devices 120 can be different than an angle A1 between another adjacent pair of biasing devices 120. However, it is preferred to have the multiple protrusions 156 positioned at an angle A1 from their adjacent neighbor to generally uniformly space the multiple protrusions 156 circumferentially around the center body 160. This tends to ensure that the center axis 52 of the centralizer 100 is generally aligned with the center axis 50 of the internal bore of the BHA 60 (or drill collar 62).

The angle A1 can be measured between adjacent centerlines 140*a-d* of the respective channels 158*a-d*, where each centerline 140*a-d* indicates the azimuthal location of the center of the respective channel 158*a-d* relative to the center axis 52 of the centralizer 100 (or bore 152).

The insert 150 can form flow paths 151*a-d* that are bounded by the body 160 of the insert, adjacent protrusions 156*a-d*, and an inner surface 132 of the sleeve 130 (or an inner surface 69 of the internal bore of the drill collar 62 when the sleeve 130 is not used). More or fewer flow paths 151 can be formed, if more or fewer protrusions are formed on the body 160 of the insert 150.

Figure 7:
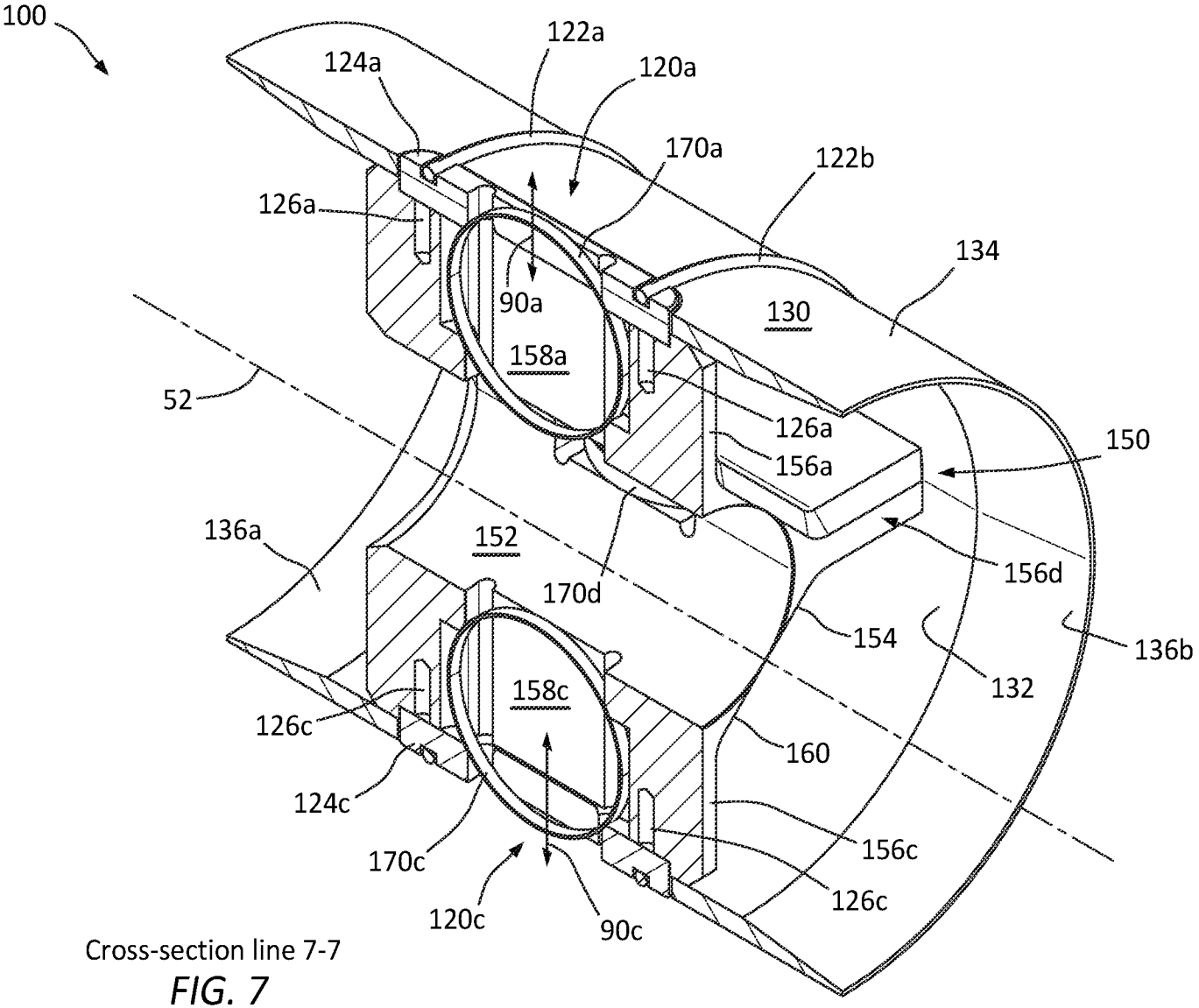
FIG. 7 is a representative partial cross-sectional perspective view along line 7-7, as indicated in FIG. 5, of a centralizer for a tool in a drill collar, in accordance with certain embodiments.

FIG. 7 is a representative partial cross-sectional perspective view along line 7-7, as indicated in FIG. 5, of a centralizer 100 for a tool 110 in a drill collar 62, in accordance with certain embodiments. The bore 152 can extend along the center axis 52 of the insert 150. In a non-limiting embodiment, the insert 150 can be installed in a sleeve 130 with the protrusions 156*a-d* substantially equally spaced around the body as described above. The sleeve 130 can include an outer surface 134 (in which the annular grooves for the retention bands 122*a-b* can be formed) and an inner surface 132 with tapered surfaces 136*a*, 136*b* at opposite ends of the inner surface 132. The tapered surfaces 136*a*, 136*b* can divert fluid flow into the flow passages 151*a-d*. The sleeve 130 can provide erosion protection for the inner surface 69 at the axial position of the centralizer 100 in the drill collar 62.

In a non-limiting embodiment, the biasing devices 120*a-d* can include a respective single biasing element 170*a-d* installed in the respective channels 158*a-d*. For example, the biasing device 120*a* can include a channel 158*a* that is open at both radial ends to allow the biasing element 170*a* to protrude from the channel 158*a* at both radial ends. The biasing element 170*a* can be installed into or removed from (arrows 90*a*, 90*c*) the channel 158*a* before the retention element 124*a* is installed through the sleeve 130 into the protrusion 156*a* at the outward radial end of the channel 158*a*. This description can also apply to the other biasing devices 120*b-d* in this embodiment, such as is similarly shown for the biasing device 120*c*. As used herein, "radial" or "radially" refers to a radial direction from a center axis, such as the center axis 52 of the centralizer 100 (or bore 152). Therefore, "radially outward" refers to radial direction away from the center axis and "radially inward" refers to radial direction toward the center axis.

Figure 8A:
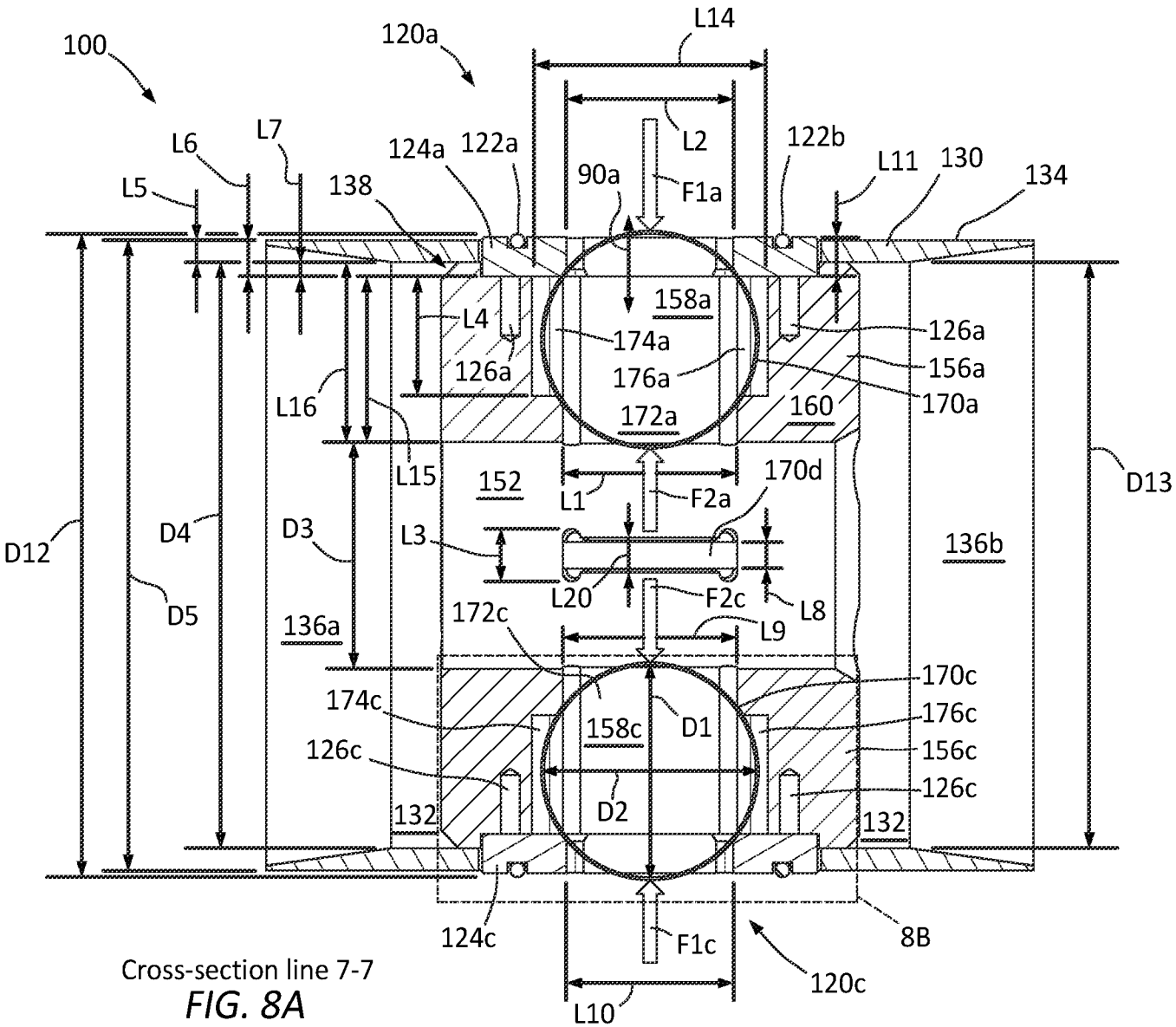
FIG. 8A is a representative partial cross-sectional side view along line 7-7, as indicated in FIG. 5, of a centralizer for a tool in a drill collar, in accordance with certain embodiments.

FIG. 8A is a representative partial cross-sectional side view along line 7-7, as indicated in FIG. 5, of a centralizer 100 for a tool 110 in a drill collar 62 (or tubular 54), in accordance with certain embodiments. In a non-limiting embodiment, the channels 158*a-d* can include a varied profile that receives the respective biasing elements 170*a-d* and captures them in their respective channels 158*a-d*, where the varied profiles prevent the biasing elements 170*a-d* from exiting through a radially inward end of the respective channels 158*a-d* while the retention elements 124*a-d* prevent removal of the respective biasing elements 170*a-d* from a radially outward end of the respective channels 158*a-d*.

For example, the varied profile of the channel 158*a* can include a center portion 172*a*, a left portion 174*a*, and a right portion 176*a*. The radially outward end of the channel 158*a* can be wider (width L14) than the radially inward end of the channel 158*a* (width L1). The width L14 of the opening of the channel 158*a* at the radially outward end can include the center, left, and right portions 172*a*, 174*a*, 176*a*, while the width L1 of the opening of the channel 158*a* at the radially inward end can include the center portion 172*a* only. This reduced width L1 can be smaller than a diameter D2 of the biasing element 170*a*, which can prevent the biasing element 170*a* from passing through the radially inward end while allowing the biasing element 170*a* to protrude radially inward from the channel 158*a* and into the bore 152 of the insert 150. This protrusion of the biasing element 170*a* into the bore 152 can allow engagement of the biasing element 170*a* with a tool 110 when the tool 110 is installed through the bore 152.

The depth L4 of the left and right portions 174*a*, 176*a* can be shorter than the depth L15 of the center portion 172*a*. This allows the radially inward end of the channel 158*a* to be narrower (width L1) than the diameter D2 of the biasing element 170*a*, while the width L14 of the radially outward end of the channel 158*a* can be larger than the diameter D2 to allow insertion (or removal) of the biasing element 170*a* into (or from) the channel 158*a* (arrows 90*a*). The width L3 of the channel 158*d* can be larger than the width L8 of the biasing element 170*d*. This also correlates to the widths of the channels 158*a-c* and the widths of the biasing elements 170*a-c*.

The channels 158*a-d* can have a larger width at each side of the respective openings in the bore 152 at the radially inward end of the channel 158*a-d* through which the respective biasing elements 170*a-d* protrude, with the center portion being thinner than at the sides. These features can help flush debris from the channels 158*a-d*. The width L8 of the biasing elements 170*a-d* should be smaller than the thinner portion of the opening in the bore 152 (and smaller than the width L20 of the respective channels 158*a-d*).

The depth L15 of the channel 158*a* can be shorter than the depth L16 of the protrusion 156*a* to allow for a recess in the end of the protrusion 156*a* that can receive the retention element 124*a*. The width L2 of the opening through the retention element 124*a* can also be smaller than the diameter D2, such that the biasing element 170*a* is retained within the channel 158*a* when the retention element 124*a* is attached (e.g., with retention bands 122*a-b* or fasteners 128*a*) to the radially outward end of the protrusion 156*a*.

The thickness of the sleeve 130 is illustrated by the width L5 which indicates the radial distance from the outer surface 134 to the inner surface 132 of the sleeve 130. The inclined surfaces 136*a*, 136*b* are tapered from the inner surface 132 such that the inner diameter of the inclined surfaces 136*a*, 136*b* increase as the inclined surfaces approach the longitudinal ends of the sleeve 130.

The retention element 124*a* is shown disposed through the sleeve 130 and into an end of the protrusion 156*a* by a distance L6, which includes the width L5 of the sleeve 130 and the distance L7 that the recess extends into the protrusion 156*a*. The distance L6 can be less than the width L11 of the retention element 124*a*, which can cause the retention element 124*a* to extend radially outward from the outer surface 134 of the sleeve 130 when the sleeve is used. However, it is not a requirement that the distance L6 be less than the width L11.

With the biasing element 170*a* protruding from both the radially outward and radially inward ends of the channel 158*a*, then the biasing element 170*a* can engage a tool 110 that is installed in the bore 152 of the centralizer 100 and a drill collar 62 in which the centralizer 100 can be installed. When installed in the drill collar 62, the biasing element 170*a* can engage an inner surface 69 of the internal bore of the drill collar 62 creating a force F1*a* acting on the biasing element 170*a* from the inner surface 69.

When the tool 110 is installed in the centralizer 100, the biasing element 170*a* can engage the tool 110 thereby creating a force F2*a* acting on the biasing element 170*a* from the tool 110. The forces F1*a*, F2*a* act on the biasing element 170*a* in opposite directions and tend to reduce the diameter D1 of the biasing element 170*a* while increasing the diameter D2 of the biasing element 170*a*. The biasing element 170*a* can electrically couple the drill collar 62 to the tool 110 (such as can be beneficial for EM telemetry) and the biasing forces F1*a*, F2*a* can help ensure that the electrical coupling is maintained during operation. The electrical coupling can also be further aided when using multiple biasing elements (e.g., biasing elements 170*a-d*) to couple the tool 110 to the drill collar 62.

Due to the resilience of the biasing element 170*a*, the biasing element 170*a* reacts with equal and opposite forces to counteract the forces F1*a*, F2*a* and thereby maintain engagement with the tool 110 and the drill collar 62. Compressing the biasing element 170*a* (i.e., reducing the diameter D1) allows the centralizer 100 to have a larger gap between the inner surface 69 and the centralizer 100 than with some other centralizers that do not include biasing devices (such as biasing devices 120). This larger gap can allow for relaxed tolerances for the inner surface 69 of the internal bore of the drill collar 62 and the outer surfaces of the centralizer 100 (e.g., surface 134 when a sleeve 130 is used, or the outer surface of the retention elements 124*a-d* when a sleeve is not used).

The larger gap can be shown as the difference between the outer diameter D5 of the sleeve 130 and the outer diameter D12 that includes the radially outward extension of the biasing elements 170*a-d* (or biasing elements 180*a-d* when used, see FIGS. 8B-8G). When the sleeve 130 is used, the centralizer 100 can allow a gap 138 between the end of the protrusions 156*a-d* and the inner surface 132 of the sleeve 130. This can allow for ease of assembly of the insert 150 into the sleeve 130.

The insert 150 can be seen as having an outer diameter D13, which can be slightly smaller than an inner diameter D4 of the sleeve, resulting in the gap 138. The bore 152 can have a diameter D3 that can be larger than the outer diameter of the tool 110. The diameter D3 can allow a larger gap between the bore 152 and the tool 110 when the biasing devices 120*a-d* are used in the centralizer 100.

The description above regarding FIG. 8A sometimes describes only one of multiple similar elements (e.g., as one of the biasing devices 120*a-d* or one of the protrusions 156*a-d*) but it should be understood that the description should also apply to the other ones of multiple similar elements. Unless otherwise stated, this applies to the rest of the description where one of a multiple similar elements is described and the other ones of the multiple similar elements are generally the same construction.

FIGS. 8B-8G are representative partial cross-sectional detailed side views of the area 8B along line 7-7, as indicated in FIG. 8A, of a biasing device 120*c* for the centralizer 100 of FIG. 8A, in accordance with certain embodiments. Each of these FIGS. 8B-8G illustrate alternative (or additional) embodiments of a biasing device 120*c* that can be used in any of the centralizers 100 to engage the inner surface 69 and the tool 110. It should also be understood that these embodiments are not mutually exclusive of each other. Each of these embodiments can be installed in any of the channels 158 of the inserts 150 in this disclosure as well as other embodiments not explicitly described in this disclosure but are in keeping with the principles of this disclosure. Therefore, the biasing element 180*c* shown in FIG. 8B or 8C can be used in an insert 150 that has other biasing elements 170*c*, 180*c* (shown in the other figures) installed therein.

Figure 8B:
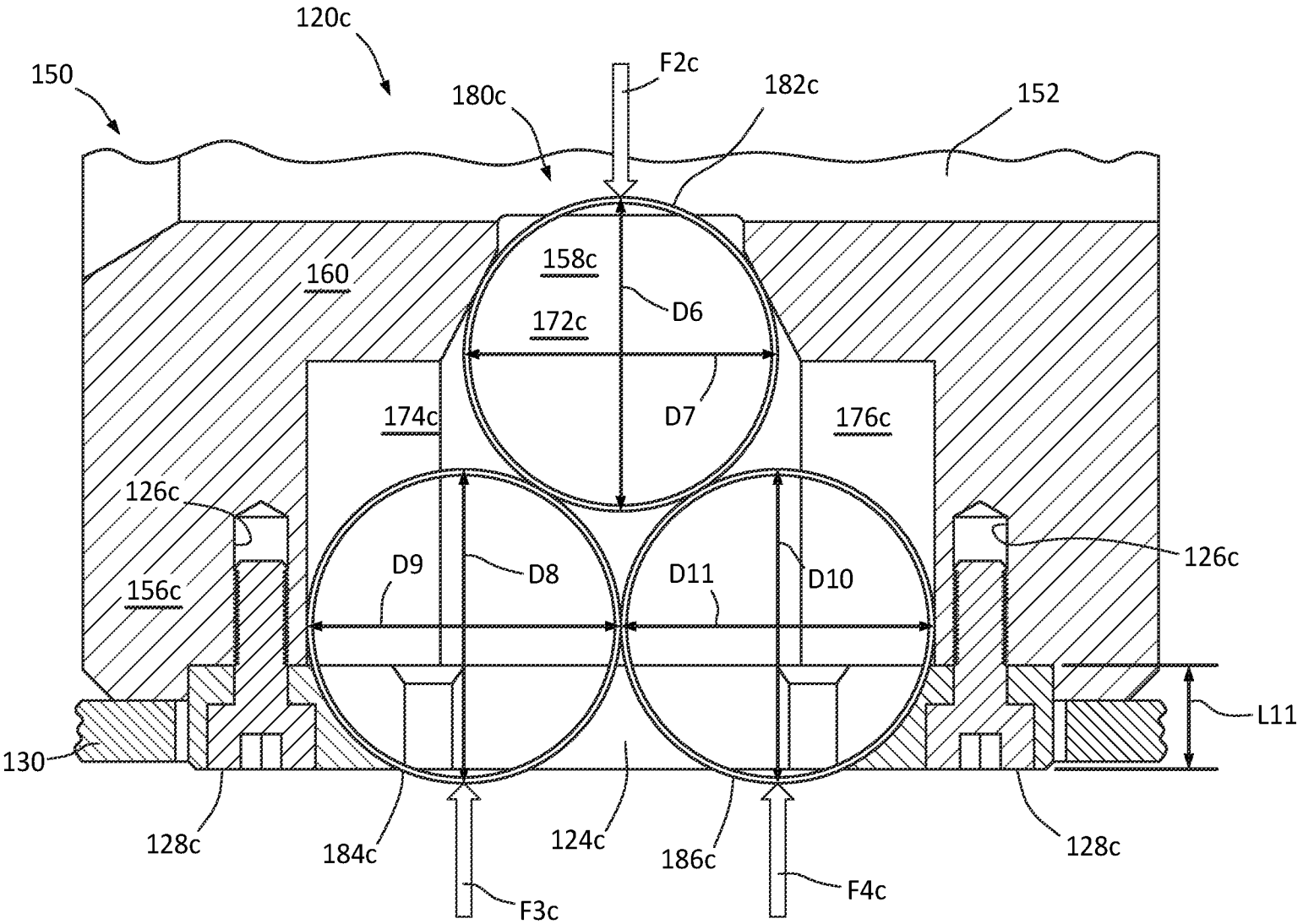
FIGS. 8B-8G are representative partial cross-sectional detailed side views along line 7-7 of the area 8B, as indicated in FIG. 8A, of a biasing device for the centralizer of FIG. 8A, in accordance with certain embodiments.

Referring to FIG. 8B, the channel 158*c* has been adapted to accommodate a biasing element 180*c* that can include multiple biasing elements 182*c*, 184*c*, 186*c*. The biasing element 180*c* can protrude radially inward from the bore 152 and radially outward from the retention element 124*c* as described above for the biasing element 170*a* (or similarly for biasing element 170*c*) causing the inner surface 69 of the internal bore of the drill collar 62 to exert a force F3*c*, F4*c* on the respective biasing elements 184*c*, 186*c*. The forces F3*c*, F4*c* tend to compress the respective biasing elements 184*c*, 186*c* (e.g., reduce respective diameters D8, D10). The biasing elements 184*c*, 186*c* can apply compressive forces to the biasing element 182*c* urging it toward a tool 110 when the tool 110 is installed in the bore 152. The tool 110 can exert a force F2*c* against the biasing element 182*c* when the tool 110 is installed in the bore 152.

The biasing element 180*c* can exert reactive forces on the inner surface 69 and the tool 110 to counteract the forces F2*c*, F3*c*, F4*c*. These forces F2*c*, F3*c*, F4*c* help ensure that engagement of the biasing element 180*c* with the inner surface 69 and the tool 110 is maintained during operation. Similar to the other biasing elements described in this disclosure, the biasing element 180*c* can absorb some vibrations from either the drill collar or tool 110 and prevent (or at least reduce or dampen) transmission of these vibrations to the other one of the drill collar or tool 110. This vibration isolation can improve the life span of the tool 110 by reducing harmful vibrations seen by the tool 110 downhole.

The channel 158*c* is generally designed to allow the biasing elements 182*c*, 184*c*, 186*c* to expand in an axial direction (i.e., longitudinal direction parallel with the center axis 52), such as increasing the respective diameters D7, D9, D11. However, when three biasing elements 182*c*, 184*c*, 186*c* are used, the expansion and compression of the biasing elements 182*c*, 184*c*, 186*c* is more complex than a single biasing element (e.g., biasing element 170*c*), since the two biasing elements 184*c*, 186*c* act on the biasing element 182*c* at an angle relative to the center axis 52.

However, regardless of the interactions of the multiple biasing elements 182*c*, 184*c*, 186*c* within the channel 158*a*, the biasing elements 182*c*, 184*c*, 186*c* (i.e., biasing element 180*c*) exert reactive forces on the inner surface 69 and the tool 110 to counteract the forces F2*c*, F3*c*, F4*c* applied to the biasing element 180*c* by the inner surface 69 or the tool 110.

In this non-limiting embodiment, the retention element 124*c* is removably attached to the protrusion 156*c* via the fasteners 128*c* installed through the retention element 124*c* into the bores 126*c*. The retention element 124*c* can have a width L11.

Figure 8C:
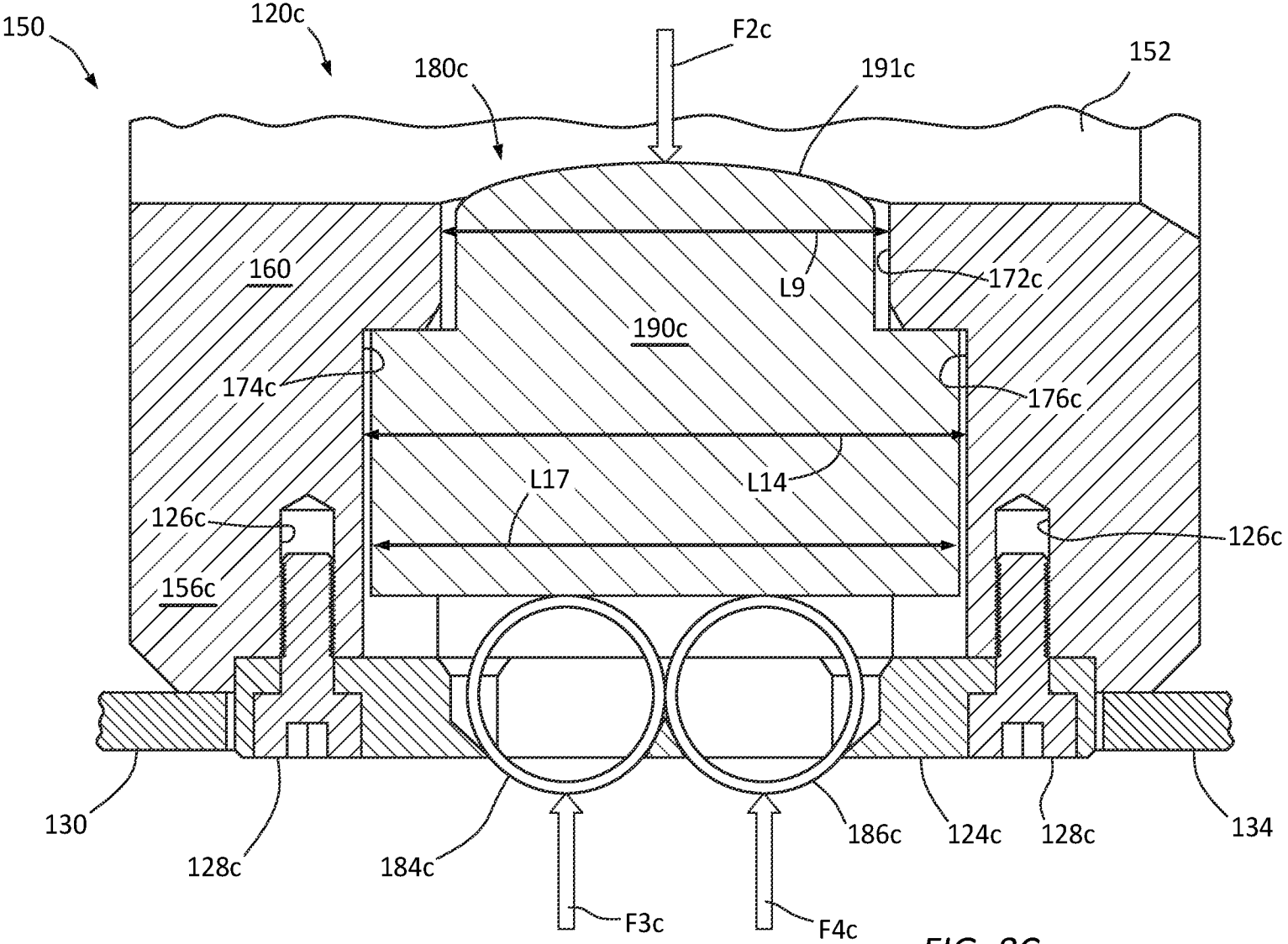

Referring to FIG. 8C, the biasing element 180*c* includes an element 190*c* that is slidably disposed in the channel 158*c*, such that it can slide radially inward or radially outward in the channel 158*c*. The element 190*c* can include an inner portion and an outer portion, where the inner portion is radially closer to the center axis 52 than the outer portion. The inner portion can be narrower than the width L9 of the center portion 172*c* of the channel 158*c*, and the outer portion can be wider (e.g., width L17) than the width L9 of the center portion 172*c* while being narrower than the width L14 which includes the center, left, and right portions 172*c*, 174*c*, 176*c* of the channel 158*c*. This can create an enlarged outer portion that is slidably disposed within the channel 158*c*. The enlarged outer portion can slide into the channel 158*c* until the shoulders of the enlarged outer portion abuts against an end of the left portion 174*c* or the right portion 176*c* of the channel 158*c*.

The enlarged outer portion can engage one or more biasing elements 184*c*, 186*c* that can be held captive in the biasing device 120*c* via the retention element 124*c*. The biasing elements 184*c*, 186*c* can be loosely arranged in the biasing device 120*c*, or the biasing elements 184*c*, 186*c* can be attached to the enlarged outer portion of the element 190*c*. The biasing elements 184*c*, 186*c* and element 190*c* can be installed together into the biasing device 120*c* as a single unit when the biasing elements 184*c*, 186*c* are attached (either removably or fixedly attached) to the element 190*c*.

The inner portion of the element 190*c* can have a surface 191*c* that engages with a tool 110 when the tool 110 is inserted into the bore 152. For example, the surface 191*c* can have a generally rounded profile, similar to the profile shown in FIG. 8C. However, the surface 191*c* can have a generally frustoconical shape with ramped edges and rounded edges. It should be understood that many other surface profiles are useable in keeping with the principles of this disclosure, as long as the surface profile allows for axial insertion of the tool 110 into the bore 152.

When the tool 110 is inserted into the bore 152, then the surface 191*c* can receive a force F2*c* acting on the element 190*c* that urges the element 190*c* radially away from the center axis 52. The biasing elements 184*c*, 186*c* can engage the inner surface 69 of the internal bore of the drill collar 62 and receive a force F3*c*, F4*c* acting on the respective biasing elements 184*c*, 186*c*. The forces F3*c*, F4*c* act on the biasing elements 184*c*, 186*c* to urge them radially inward toward the center axis 52 in opposition to the force F2*c*. The biasing element 180*c* applies reactive forces to counteract the forces F2*c*, F3*c*, F4*c* and thereby maintains engagement of the biasing element 180*c* with the inner surface 69 and the tool 110.

The biasing element 180*c* can be replaced by removing the retention element 124*c*, removing the biasing element 180*c* from the channel 158*c*, installing a different biasing element 180*c* (or biasing element 170*c*), and reinstalling a retention element 124*c* (or different retention element 124*c*).

Figure 8D:
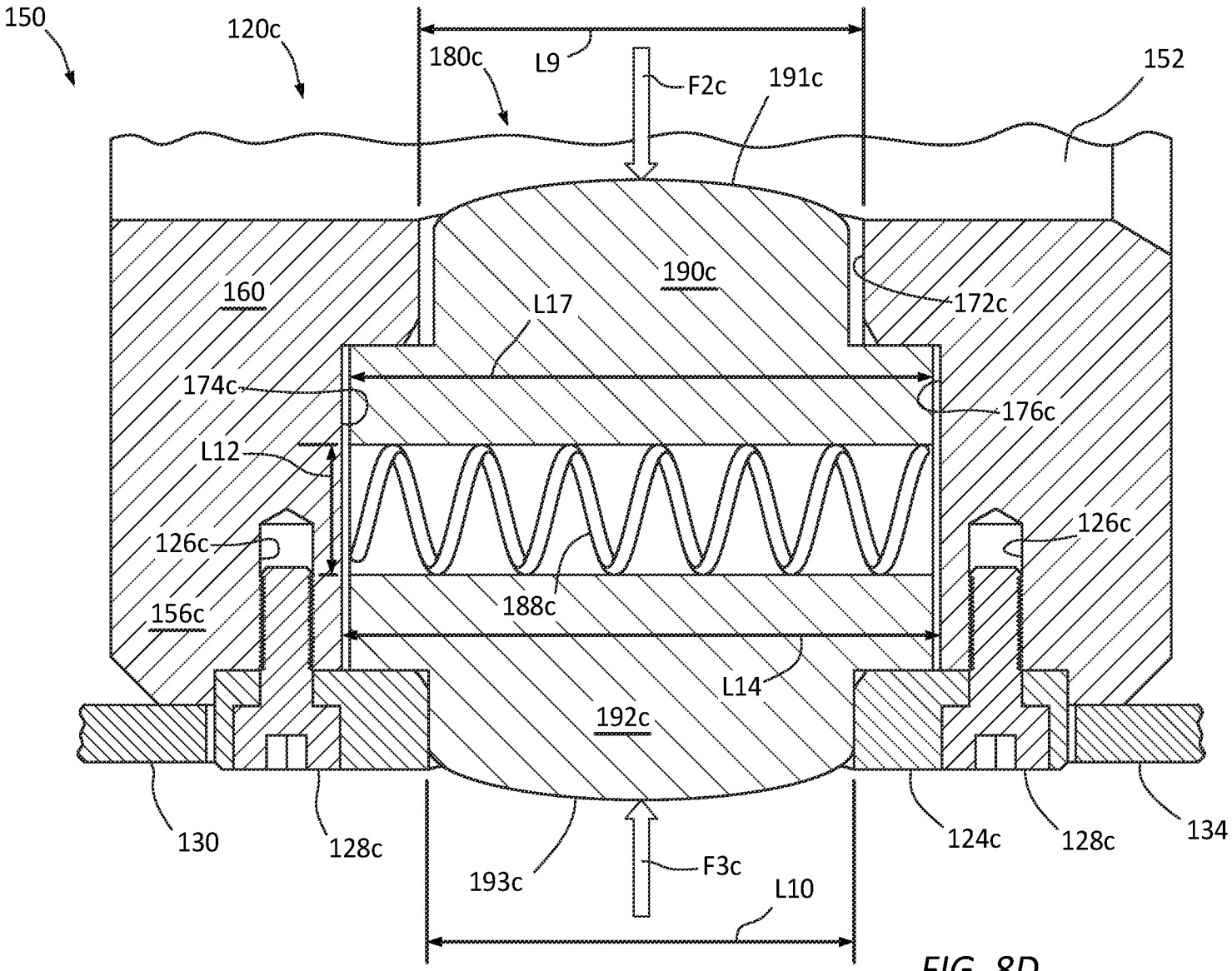

Referring to FIG. 8D, the biasing element 180*c* can include elements 190*c*, 192*c* that are slidably disposed in the channel 158*c* with a biasing element 188*c* radially disposed between them. The elements 190*c*, 192*c* can slide radially inward or radially outward in the channel 158*c*, such as when they are being installed or removed from the channel 158*c*. The elements 190*c*, 192*c* can also slide in opposite radial directions in the channel 158*c*, such as when the forces F2*c* and F3*c* are acting on the biasing element 180*c*.

The element 190*c* can include an inner portion and an outer portion, where the inner portion is radially closer to the center axis 52 than the outer portion. The inner portion can be narrower than the width L9 of the center portion 172*c* of the channel 158*c*, and the outer portion can be wider (e.g., width L17) than the width L9 of the center portion 172*c* while being narrower than the width L14 which includes the center, left, and right portions 172*c*, 174*c*, 176*c* of the channel 158*c*. This can create an enlarged outer portion that is slidably disposed within the channel 158*c*. The enlarged outer portion of the element 190*c* can slide into the channel 158*c* until the shoulders of the enlarged outer portion abuts against an end of the left portion 174*c* or the right portion 176*c* of the channel 158*c*.

The element 192*c* can include an inner portion and an outer portion, where the inner portion is radially closer to the center axis 52 than the outer portion. The outer portion can be narrower than the width L10 of the opening in the retention element 124*c*, and the inner portion can be wider (e.g., width L17) than the width L10 of the opening in the retention element 124*c* while being narrower than the width L14 which includes the center, left, and right portions 172*c*, 174*c*, 176*c* of the channel 158*c*. This can create an enlarged inner portion that is slidably disposed within the channel 158*c*. The enlarged inner portion of the element 192*c* can abut the retention element 124*c* when the retention element 124*c* is installed, thereby retaining the biasing element 180*c* in the biasing device 120*c*.

A biasing element 188*c* can be disposed radially between the elements 190*c* and 192*c* and resist movement of the elements 190*c* and 192*c* radially toward each other. When the tool 110 is installed in the bore 152 and the centralizer 100 is installed in the drill collar 62, a force F2*c* from the tool 110 can act on the surface 191*c* of the element 190*c*, and a force F3*c* from the drill collar 62 can act on the surface 193*c* of the element 192*c*. The biasing element 180*c* provides reaction forces that counteract the forces F2*c*, F3*c*. These forces can equalize when the biasing element 188*c* is sufficiently compressed between the elements 190*c*, 192*c*. Surfaces 191*c*, 193*c* can each have a generally rounded profile, similar to the profile shown in FIG. 8D. However, the surfaces 191*c*, 193*c* can each have a generally frustoconical shape with ramped edges and rounded edges. It should be understood that many other surface profiles are useable in keeping with the principles of this disclosure, as long as the surface profile allows for axial insertion of the tool 110 into the bore 152 and the axial insertion of the centralizer 100 in the drill collar 62 or tubular 54.

The biasing element 188*c* can be loosely arranged between the elements 190*c*, 192*c*, or the biasing element 188*c* can be removably or fixedly attached to either one of or both of the elements 190*c*, 192*c*. In this configuration, the biasing element 188*c* may need to be attached in a way that allows for axial movement as well as radial movement of the biasing element 188*c*. It should also be understood that the biasing element 188*c* can be any other biasing element that provides a sufficient biasing force between the elements 190*c*, 192*c*. For example, the biasing element 188*c* can be similar to the biasing element 182*c* shown in FIG. 8F, or it can be a resilient material (e.g., rubber, etc.) that is attached between the elements 190*c*, 192*c* and provides the required biasing forces to operate the biasing device 120*c*.

The biasing element 180*c* can be replaced by removing the retention element 124*c*, removing the biasing element 180*c* from the channel 158*c*, installing a different biasing element 180*c* (or biasing element 170*c*), and reinstalling a retention element 124*c* (or different retention element 124*c*).

Figure 8E:
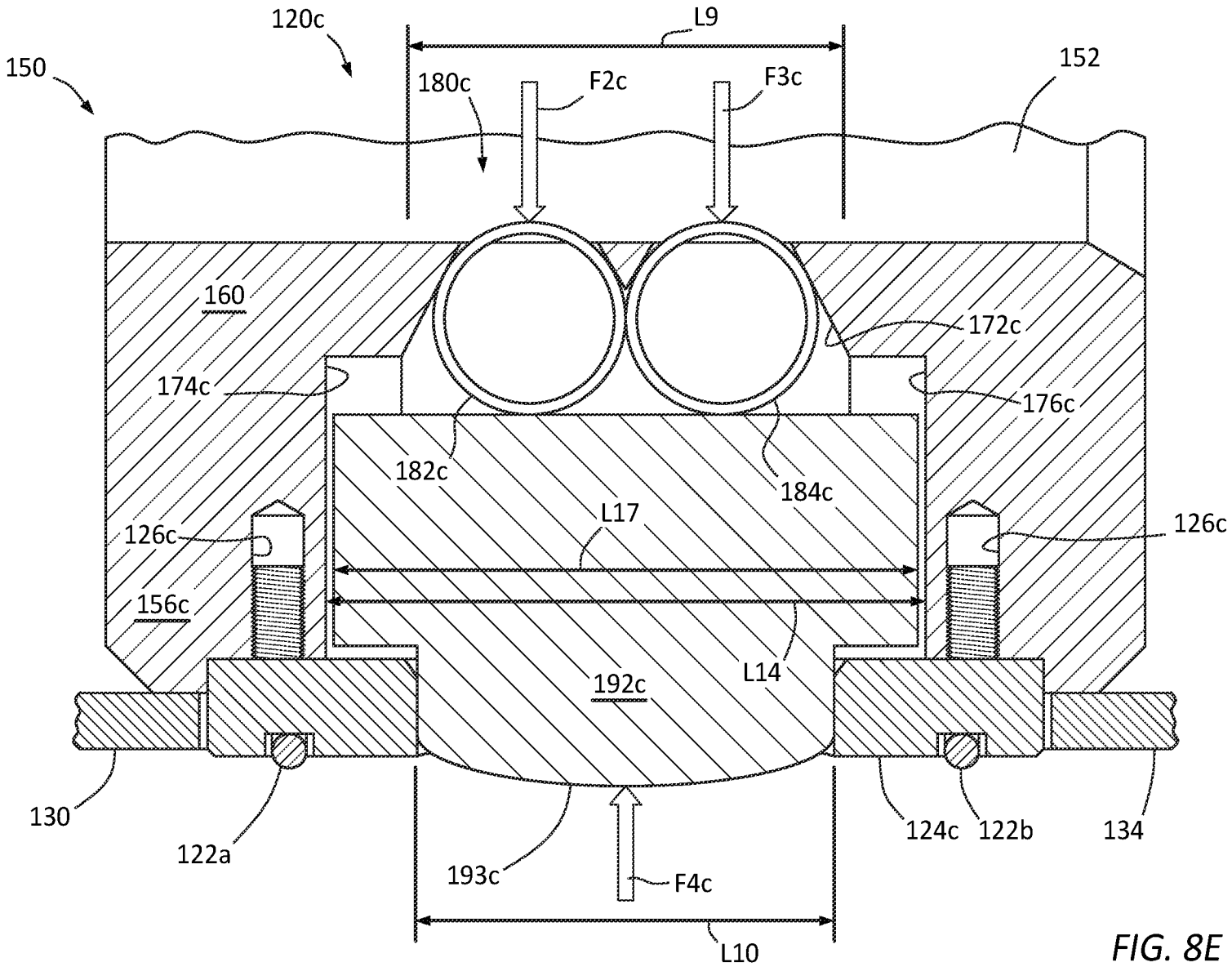

Referring to FIG. 8E, this configuration of the biasing element 180*c* is generally an inverted version of the biasing element 180*c* shown in FIG. 8C. The biasing element 180*c* can include an element 192*c* that is slidably disposed in the channel 158*c*, such that it can slide radially inward or radially outward in the channel 158*c*. The element 192*c* can include an inner portion and an outer portion, where the inner portion is radially closer to the center axis 52 than the outer portion. The outer portion can be narrower than the width L10 of the opening in the retention element 124*c*, and the inner portion can be wider (e.g., width L17) than the width L10 of the opening in the retention element 124*c* while being narrower than the width L14 which includes the center, left, and right portions 172*c*, 174*c*, 176*c* of the channel 158*c*. This can create an enlarged inner portion that is slidably disposed within the channel 158*c*. The enlarged inner portion of the element 192*c* can abut the retention element 124*c* when the retention element 124*c* is installed, thereby retaining the biasing element 180*c* in the biasing device 120*c*.

The inner portion can engage one or more biasing elements 182*c*, 184*c* that can be held captive in the biasing device 120*c* via retention features of the body 160. The biasing elements 182*c*, 184*c* can be loosely arranged in the biasing device 120*c*, or the biasing elements 182*c*, 184*c* can be attached to the inner portion of the element 192*c*. The biasing elements 182*c*, 184*c* and the element 192*c* can be installed into the biasing device 120*c* as a unit when the biasing elements 182*c*, 184*c* are attached (either removably or fixedly attached) to the element 192*c*.

The outer portion of the element 192*c* can have a surface 193*c* that engages with the inner surface 69 of the internal bore of the drill collar 62 when the centralizer 100 is installed in the drill collar 62 (or tubular 54). For example, the surface 193*c* can have a generally rounded profile, similar to the profile shown in FIG. 8E. However, the surface 193*c* can have a generally frustoconical shape with ramped edges and rounded edges. It should be understood that many other surface profiles are useable in keeping with the principles of this disclosure, as long as the surface profile allows for axial insertion of the centralizer 100 into the drill collar 62 or tubular 54.

When the centralizer 100 is installed in the drill collar 62, then the surface 193*c* can receive a force F4*c* acting on the element 192*c* that urges the element 192*c* radially toward the center axis 52. The biasing elements 182*c*, 184*c* can engage the tool 110 and receive forces F2*c*, F3*c* acting on the respective biasing elements 182*c*, 184*c*. The forces F2*c*, F3*c* can act on the biasing elements 182*c*, 184*c* to urge them radially outward away from the center axis 52 in opposition to the force F4*c*. The biasing element 180*c* applies reactive forces to counteract the forces F2*c*, F3*c*, F4*c* and thereby maintains engagement of the biasing element 180*c* with the inner surface 69 and the tool 110.

The biasing element 180*c* can be replaced by removing the retention element 124*c*, removing the biasing element 180*c* from the channel 158*c*, installing a different biasing element 180*c* (or biasing element 170*c*), and reinstalling a retention element 124*c* (or different retention element 124*c*).

Figure 8F:
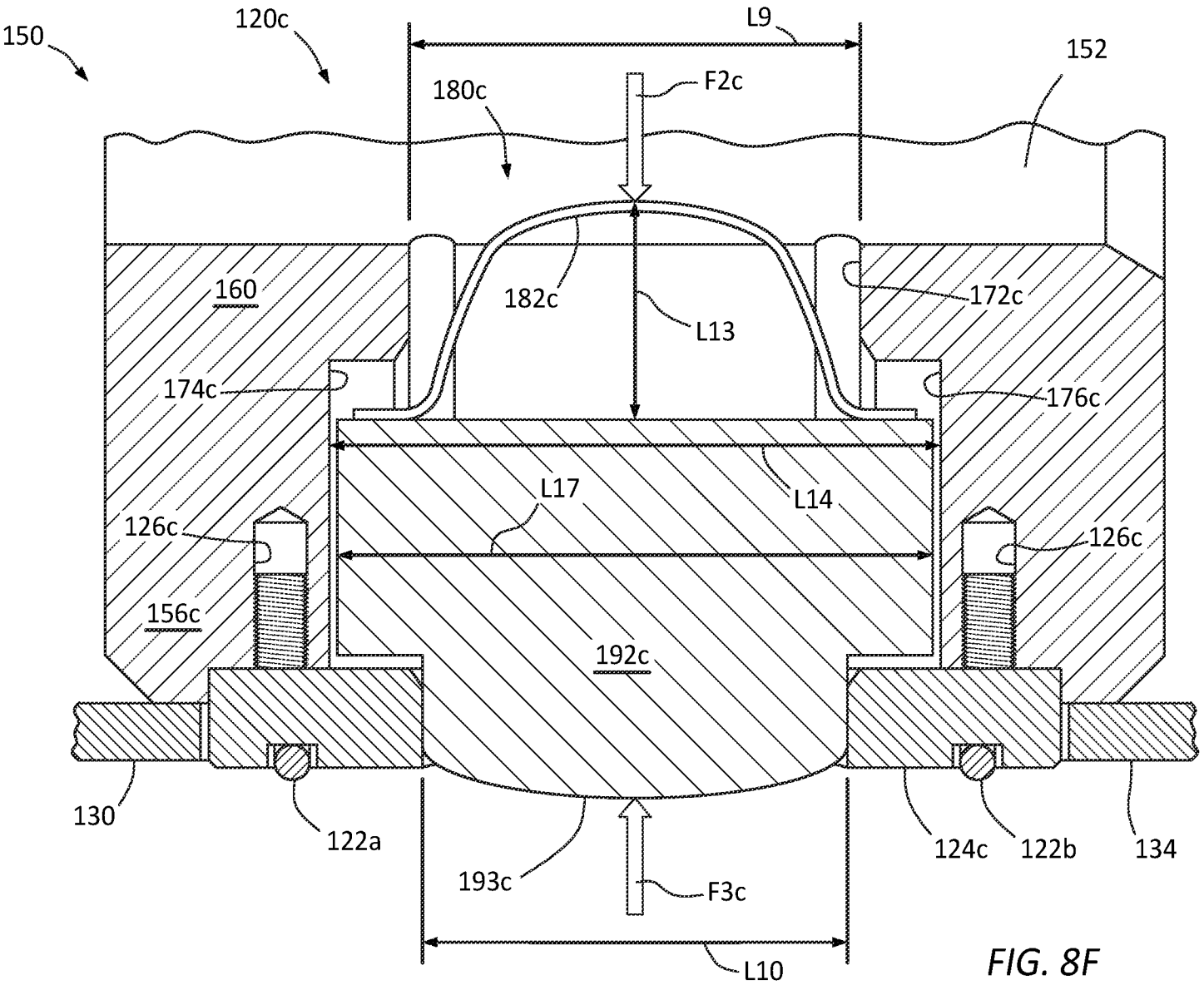

Referring to FIG. 8F, the biasing element 180*c* can include an element 192*c* that is slidably disposed in the channel 158*c*, such that it can slide radially inward or radially outward in the channel 158*c*. The element 192*c* can include an inner portion and an outer portion, where the inner portion is radially closer to the center axis 52 than the outer portion. The outer portion can be narrower than the width L10 of the opening in the retention element 124*c*, and the inner portion can be wider (e.g., width L17) than the width L10 of the opening in the retention element 124*c* while being narrower than the width L14 which includes the center, left, and right portions 172*c*, 174*c*, 176*c* of the channel 158*c*. This can create an enlarged inner portion that is slidably disposed within the channel 158*c*. The enlarged inner portion of the element 192*c* can abut the retention element 124*c* when the retention element 124*c* is installed, thereby retaining the biasing element 180*c* in the biasing device 120*c*.

The inner portion can engage a biasing element 182*c* that can be held captive in the biasing device 120*c* via retention features of the body 160. The biasing element 182*c* can be loosely arranged in the biasing device 120*c*, or the biasing element 182*c* can be attached to the inner portion of the element 192*c*. The biasing element 182*c* and the element 192*c* can be installed into the biasing device 120*c* as a unit when the biasing element 182*c* is attached (either removably or fixedly attached) to the element 192*c*.

The outer portion of the element 192*c* can have a surface 193*c* that engages with the inner surface 69 when the centralizer 100 is installed in the drill collar 62 or tubular 54. For example, the curved surface 193*c* can have a generally rounded profile, similar to the profile shown in FIG. 8F. An inclined surface 191*c* can have a generally frustoconical shape with ramped edges. However, the surface 193*c* can have a generally frustoconical shape with ramped edges and rounded edges. It should be understood that many other surface profiles are usable in keeping with the principles of this disclosure, as long as the surface profile allows for axial insertion of the centralizer 100 into the drill collar 62 or tubular 54.

When the centralizer 100 is installed in the drill collar 62, then the surface 193*c* can receive a force F3*c* acting on the element 192*c* that urges the element 192*c* radially toward from the center axis 52. The biasing element 182*c* can engage the tool 110 and receive a force F2*c* acting on the biasing element 182*c*. The force F2*c* acts on the biasing element 182*c* to urge it radially outward away from the center axis 52 in opposition to the force F3*c*. The biasing element 180*c* applies reactive forces to counteract the forces F2*c*, F3*c* and thereby maintains engagement of the biasing element 180*c* with the inner surface 69 and the tool 110.

The biasing element 180*c* can be replaced by removing the retention element 124*c*, removing the biasing element 180*c* from the channel 158*c*, installing a different biasing element 180*c* (or biasing element 170*c*), and reinstalling a retention element 124*c* (or different retention element 124*c*).

Figure 8G:
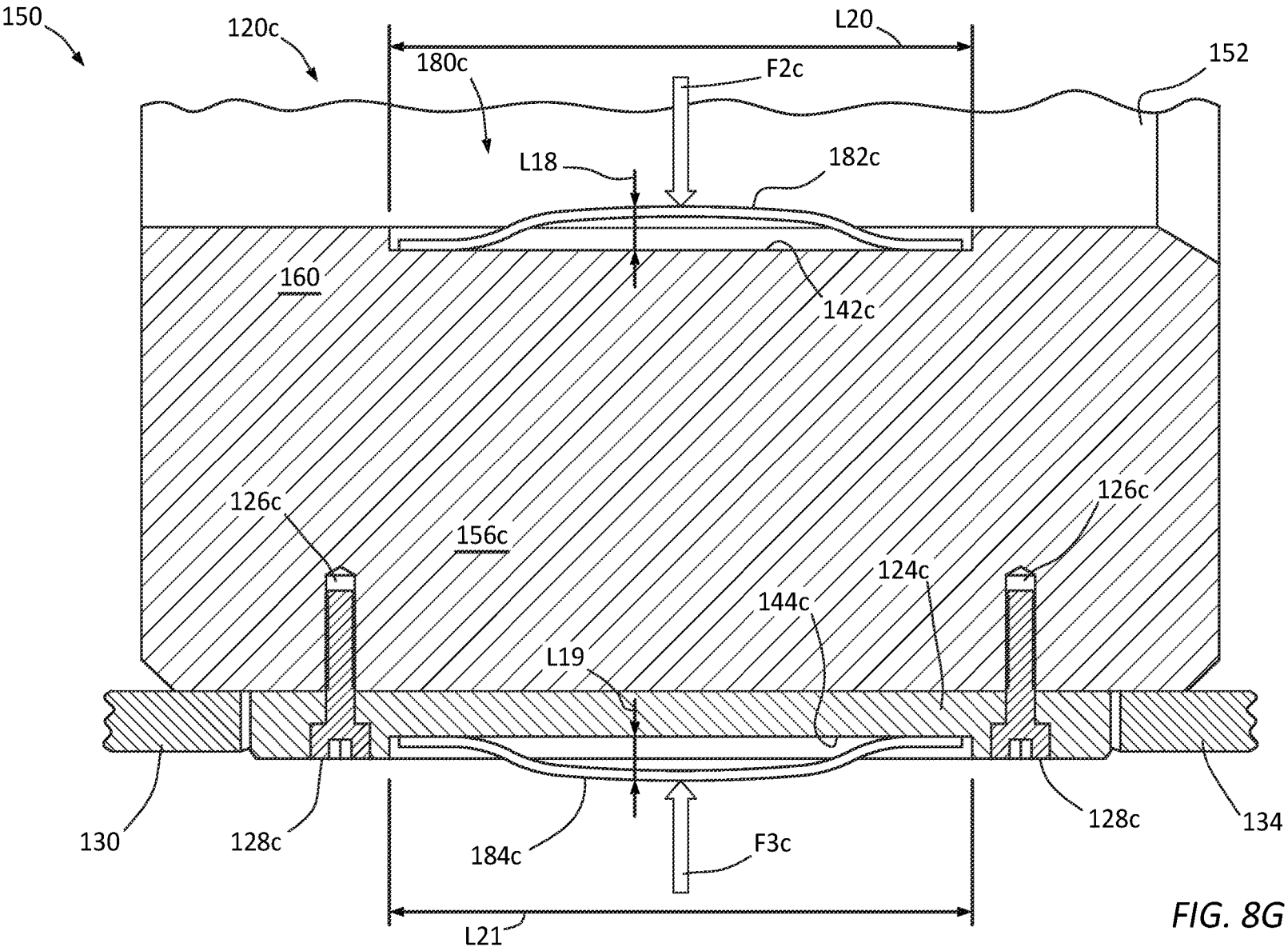

Referring to FIG. 8G, the biasing element 180*c* can include a biasing element 184*c* that is (fixedly or removably) attached in a recess 144*c* of the retention element 124*c*, such that it is secured to the retention element 124*c* within the recess 144*c* and a portion of the biasing element 184*c* extends radially outward past a radially outermost surface of the retention element 124*c*. The recess 144*c* can have a width L21 that can be wider than the biasing element 184*c* is long.

The biasing element 180*c* can include a biasing element 182*c* that is (fixedly or removably) attached in a recess 142*c* formed in the bore 152, such that it is secured to the body 160 within the recess 142*c* and a portion of the biasing element 182*c* extends radially inward past the radially innermost surface of the bore 152.

When the tool 110 is installed in the centralizer 100, the biasing element 182*c* can receive a force F2*c* from the tool 110 that tends to reduce the distance L18 of the biasing element 182*c* and compress the biasing element 182*c* away from the center axis 52. When the centralizer 100 is installed in the drill collar 62, the biasing element 184*c* can receive a force F3*c* from the drill collar 62 that tends to reduce the distance L19 of the biasing element 184*c* and compress the biasing element 184*c* toward the center axis 52.

The force F2*c* acts on the biasing element 182*c* to urge it radially outward away from the center axis 52 in opposition to the force F3*c*. The biasing element 180*c* applies reactive forces to counteract the forces F2*c*, F3*c* and thereby maintains engagement of the biasing element 180*c* with the inner surface 69 and the tool 110.

The biasing element 180*c* can be replaced by removing and replacing the biasing element 182*c* in the recess 142*c* and removing and replacing the biasing element 184*c* in the recess 144*c* in the retention element 124*c*. Alternatively, or in addition to, the biasing element 184*c* can be removed and replaced by removing and replacing the retention element 124*c* with a new retention element 124*c* that includes a new biasing element 184*c*.

Figure 9:
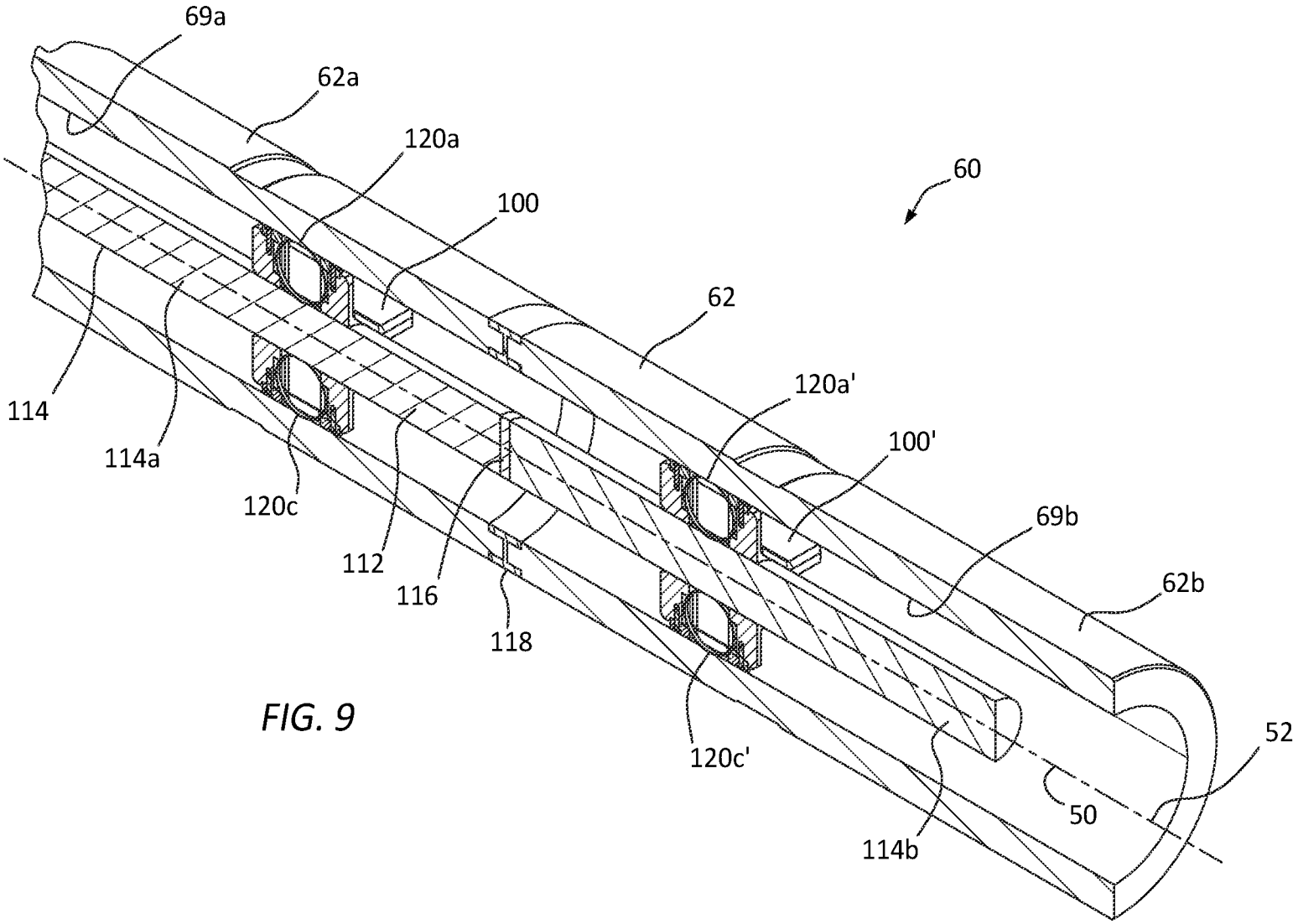
FIG. 9 is a representative partial cross-sectional perspective view of a tool mounted in a drill collar with centralizers that have no sleeve, in accordance with certain embodiments.

FIG. 9 is a representative partial cross-sectional perspective view of a tool 110 mounted in a drill collar 62 with centralizers 100, 100' having no sleeve, in accordance with certain embodiments. The portion of a BHA 60 shown in FIG. 9 is similar to a portion of a BHA 60 shown in FIG. 4B, where the drill collar 62 includes upper and lower sections 62*a*, 62*b* that are electrically isolated by an insulation spacer 118. The probe 114 (or tool 110) can include upper and lower portions 114*a*, 114*b* that are electrically isolated by an insulation spacer 116. Each centralizer 100, 100' can include multiple protrusions 156 in which respective ones of multiple biasing devices (e.g., biasing devices 120*a*, 120*c*, 120*a*', 120*b*') are installed. The biasing devices can be retained in the protrusions by the respective retention elements 124.

Figure 10A:
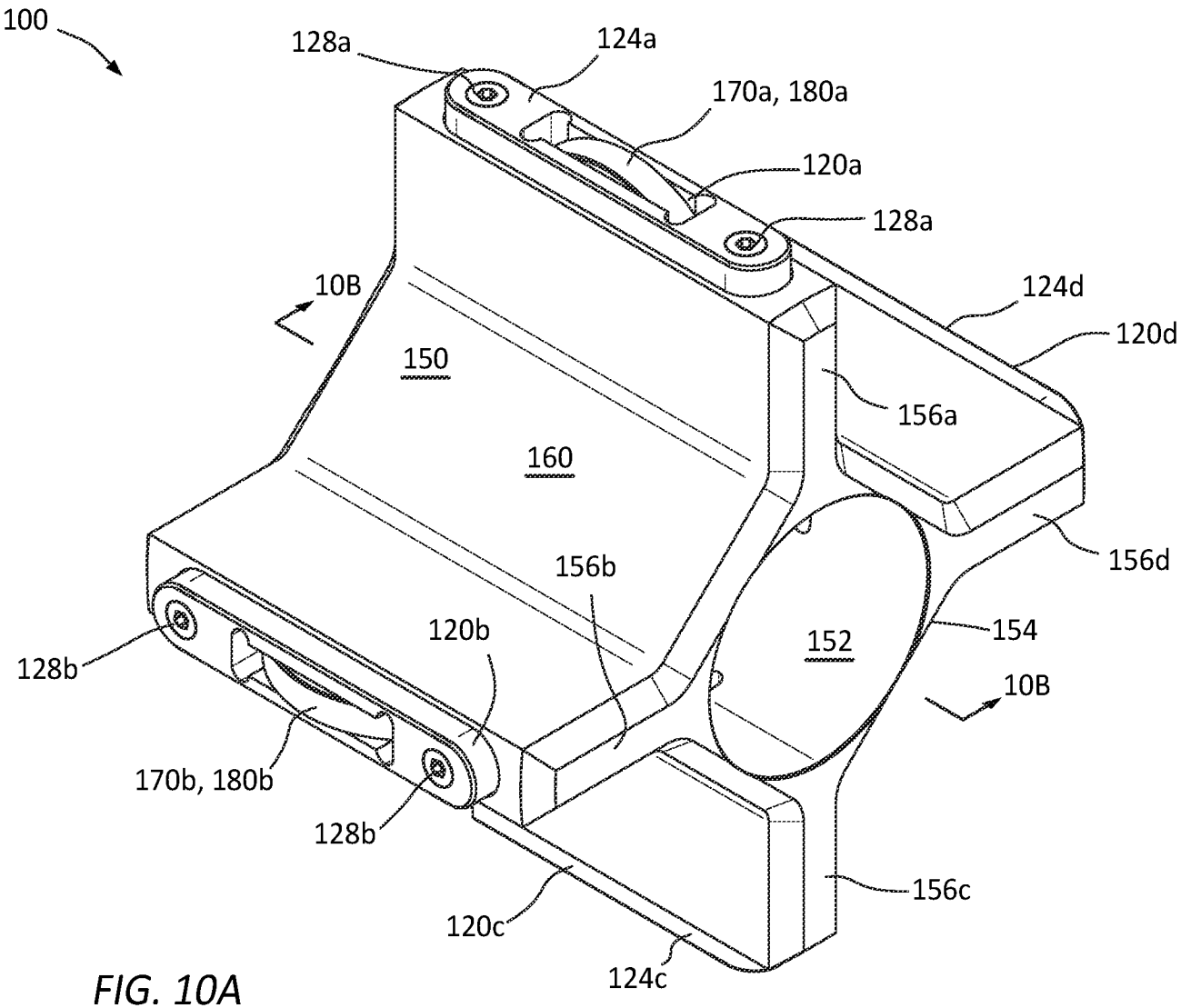
FIG. 10A is a representative perspective view of a centralizer, without a sleeve, for a tool in a drill collar, in accordance with certain embodiments.
Figure 10B:
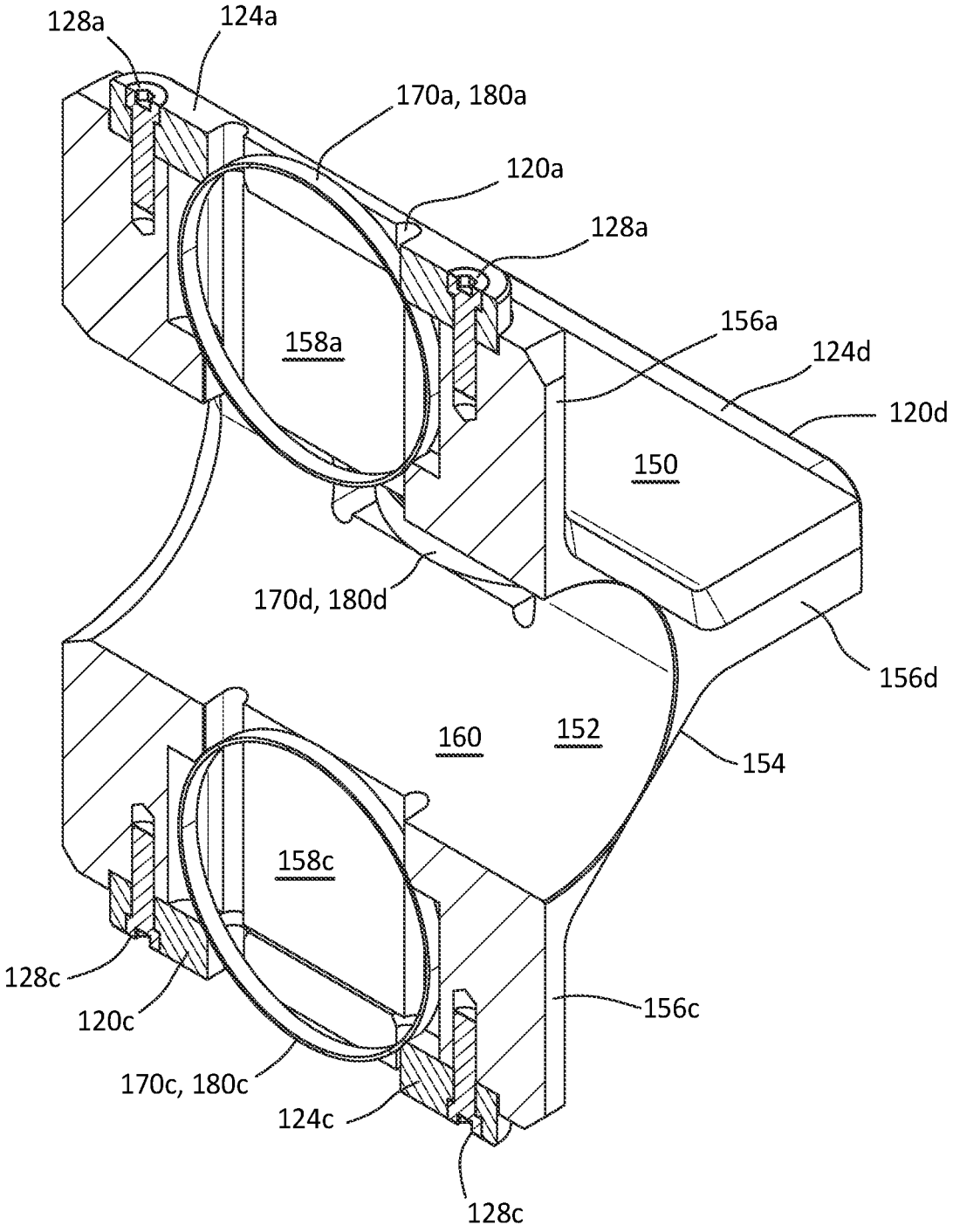
FIG. 10B is a representative partial cross-sectional side view along line 10B-10B, as indicated in FIG. 10A, of a centralizer, without a sleeve, for a tool in a drill collar, in accordance with certain embodiments.

In this configuration, the centralizers 100, 100' do not include a sleeve 130 like the sleeve that is shown in at least FIGS. 4B and 5. The sleeves 130 are generally used to minimize erosion of the drill collar 62 at the axial position of the centralizer 100, 100' due to increased fluid velocity caused by the centralizer 100, 100'. However, as shown in FIGS. 9, 10A and 10B, the sleeve 130 is not required for operation of the centralizers 100, 100', such as centralizing the probe 114 (or tool 110) and providing electrical coupling between the drill collar 62 and the probe 114. Any of the biasing elements 170*c*, 180*c* shown in FIGS. 8A-8G can be used as biasing elements in the centralizers 100, 100'.

FIG. 10A is a representative perspective view of a centralizer 100 for a tool 110 in a drill collar 62, in accordance with certain embodiments, where the centralizer 100 does not include a sleeve 130. A described above, the centralizer 100 can include multiple protrusions 156 (e.g., protrusions 156*a-d*) that extend from the center body 160. The center body 160 can include a central bore 152 therethrough that can receive a tool 110. The centralizer 100 can be installed within a drill collar 62 to engage an inner surface 69 of the internal bore of the drill collar 62.

The biasing devices 120 can be installed in respective protrusions and retained in the protrusions 156 by the retention elements 124 (e.g., retention elements 124*a-d*), which can be removably attached to the respective protrusions 156 via the fasteners 128 (e.g., fasteners 128*a-d*). The biasing devices 120 can each include a biasing element 170 or 180 (e.g., any one of biasing elements 170*a-d* or 180*a-d*), with these biasing elements 170, 180 described in more detail above regarding FIGS. 8A through 8G. The biasing elements 170 or 180 can engage the tool 110 and the inner surface 69 of the internal bore of the drill collar 62 via the biasing forces created by the biasing elements when they are compressed.

FIG. 10B is a representative partial cross-sectional side view along line 10B-10B, as indicated in FIG. 10A, of a centralizer 100 for a tool 110 in a drill collar 62, in accordance with certain embodiments, where the centralizer 100 does not include a sleeve 130. The elements in FIG. 10B, with like reference numerals to the reference numerals in FIG. 7, perform similar functions as described for the like referenced items in FIG. 7. This view merely shows the centralizer 100 without a sleeve 130. Please note that the biasing elements 170 in FIG. 7 can also be any of the biasing elements 180*c* as shown in FIGS. 8B-8G.

Various Embodiments

Embodiment 1. A system for a subterranean operation, the system comprising:

a drill collar with an internal bore;

a tool positioned within the internal bore; and a centralizer radially positioned between the tool and the drill collar, wherein the centralizer engages the internal bore and the tool via a plurality of biasing devices.

Embodiment 2. The system of embodiment 1, wherein at least one of the plurality of biasing devices electrically couples the tool to the drill collar.

Embodiment 3. The system of embodiment 2, wherein the at least one of the plurality of biasing devices is in a path of transmission of electrical energy between the tool and the drill collar.

Embodiment 4. The system of embodiment 1, wherein the plurality of biasing devices urge a longitudinal center axis of the centralizer to be substantially aligned with a longitudinal center axis of the internal bore of the drill collar.

Embodiment 5. The system of embodiment 1, wherein the plurality of biasing devices urge a longitudinal center axis of the tool to be substantially aligned with a longitudinal center axis of the centralizer.

Embodiment 6. The system of embodiment 1, wherein the centralizer further comprises a plurality of protrusions that extend radially out from a body of the centralizer and radially away from a center axis of the centralizer.

Embodiment 7. The system of embodiment 6, wherein each of the plurality of biasing devices is disposed in a respective one of the plurality of protrusions.

Embodiment 8. The system of embodiment 6, wherein the plurality of biasing devices comprise a first biasing device and a second biasing device, wherein the plurality of protrusions comprise a first protrusion and a second protrusion, and wherein the first biasing device is disposed in the first protrusion and the second biasing device is disposed in the second protrusion.

Embodiment 9. The system of embodiment 8, wherein the first biasing device comprises a first biasing element, and wherein the first biasing element is disposed within a first channel in the first protrusion, and wherein a first portion of the first biasing element extends radially inward from the first channel and a second portion of the first biasing element extends radially outward from the first channel.

Embodiment 10. The system of embodiment 9, wherein the first portion engages the tool when the tool is installed through a center bore of the centralizer, and wherein the second portion engages an inner surface of the internal bore of the drill collar when the centralizer is installed in the internal bore of the drill collar.

Embodiment 11. The system of embodiment 9, wherein the first channel comprises a varied profile that retains the first biasing element within the first channel and prevents the first biasing element from exiting the first channel.

Embodiment 12. The system of embodiment 11, wherein a first retention element is removably attached to an outer radial end of the first protrusion, such that the first biasing element is prevented from exiting the first channel through the outer radial end of the first protrusion.

Embodiment 13. The system of embodiment 12, wherein the first retention element is removably attached to the outer radial end of the first protrusion via one or more fasteners or one or more retention bands.

Embodiment 14. The system of embodiment 1, wherein the centralizer comprises an insert with a plurality of protrusions extending radially outward from a central body, and wherein the central body comprises a central bore extending longitudinally through the central body along a center axis of the centralizer.

Embodiment 15. The system of embodiment 14, wherein the insert is positioned within a sleeve, and wherein the plurality of biasing devices extend radially outward through the sleeve.

Embodiment 16. The system of embodiment 14, wherein a first biasing element extends into the central bore and resiliently engages the tool, wherein a second biasing element extends radially outward from one of the plurality of protrusions and resiliently engages the internal bore of the drill collar.

Embodiment 17. The system of embodiment 14, wherein a first biasing element extends into the central bore and resiliently engages the tool, and wherein the first biasing element extends radially outward from one of the plurality of protrusions and resiliently engages the internal bore of the drill collar.

Embodiment 18. The system of embodiment 14, wherein a biasing element is disposed in an internal channel in each one of the plurality of protrusions, and wherein each one of the plurality of protrusions is circumferentially spaced away from an adjacent one of the plurality of protrusions by a substantially equal distance.

Embodiment 19. The system of embodiment 18, wherein the biasing element extends into the central bore and resiliently engages the tool, and wherein the biasing element extends radially outward from a respective one of the plurality of protrusions and resiliently engages the internal bore of the drill collar.

Embodiment 20. The system of embodiment 18, wherein the biasing element comprises a first biasing element and a second biasing element, wherein the first biasing element engages the internal bore and the second biasing element engages the tool, and wherein the first biasing element and the second biasing element engage each other.

Embodiment 21. The system of embodiment 18, wherein the biasing element comprises a first biasing element and a second biasing element, wherein the first biasing element engages the internal bore and the second biasing element engages the tool.

Embodiment 22. The system of embodiment 21, wherein the first biasing element and the second biasing element are electrically coupled to each other.

Embodiment 23. The system of embodiment 18, wherein the biasing element comprises a first biasing element, a second biasing element, and a third biasing element, wherein the first biasing element engages the internal bore, wherein the second biasing element and the third biasing element engages the tool, and wherein the first biasing element engages the second biasing element and the third biasing element.

Embodiment 24. The system of embodiment 18, wherein the biasing element comprises a first biasing element, a second biasing element, and a third biasing element, wherein the first biasing element and the second biasing element engages the internal bore, wherein the third biasing element engages the tool, and wherein the third biasing element engages the first biasing element and the second biasing element.

Embodiment 25. The system of embodiment 1, wherein the plurality of biasing devices dampen vibrations transmitted from the drill collar to the tool.

Embodiment 26. A system for a subterranean operation, the system comprising:

a tubular with an internal bore;

a tool positioned within the internal bore; and a centralizer radially positioned between the tool and the tubular, wherein the centralizer engages the internal bore and the tool via a plurality of biasing devices.

Embodiment 27. A system for a subterranean operation, the system comprising:

a tubular with an internal bore;

a tool positioned within the internal bore; and a centralizer radially positioned between the tool and the tubular, the centralizer comprising a biasing device and a sleeve, wherein the biasing device extends radially through a wall of the sleeve.

Embodiment 28. A bottom hole assembly (BHA) for a subterranean operation, the BHA comprising:

a drill collar with an internal bore;

a tool positioned within the internal bore; and a plurality of centralizers radially positioned between the tool and the drill collar, the centralizer comprising an insert with a plurality of protrusions extending from a central body and a biasing device positioned within each protrusion.

Embodiment 29. The BHA of embodiment 28, wherein the tool comprises a lower portion and an upper portion, with the upper portion electrically isolated from the lower portion, and wherein the drill collar comprises a lower segment and an upper segment, with the upper segment being electrically isolated from the lower segment, and wherein the plurality of centralizers comprises a first centralizer and a second centralizer.

Embodiment 30. The BHA of embodiment 29, wherein the first centralizer is radially positioned between the upper portion of the tool and the upper segment of the drill collar, and wherein the second centralizer is radially positioned between the lower portion of the tool and the lower segment of the drill collar.

Embodiment 31. The BHA of embodiment 29, wherein the biasing devices of the first centralizer electrically couples the upper portion of the tool to the upper segment of the drill collar, and wherein the biasing devices of the second centralizer electrically couples the lower portion of the tool and the lower segment of the drill collar.

Embodiment 32. The BHA of embodiment 31, wherein a first voltage potential between the lower portion and the upper portion of the tool is varied, and wherein a second voltage potential between the lower segment and the upper segment of the drill collar is varied in response to variations of the first voltage potential.

Embodiment 33. The BHA of embodiment 32, wherein variations in the second voltage potential creates electromagnetic signals that are transmitted into an earthen formation.

Embodiment 34. A method of centralizing a tool within a tubular for a subterranean operation, the method comprising:

inserting a portion of a tool through an internal bore of a centralizer;

installing the tool and the centralizer in an internal bore of a tubular, the centralizer comprising an insert which comprises a plurality of protrusions extending from a central body, and a biasing device positioned within each of the plurality of protrusions, wherein at least a portion of the biasing device extends external to each respective one of the plurality of protrusions; and applying a biasing force to an outer surface of the tool and an inner surface of the internal bore of the tubular via each of the biasing devices.

Embodiment 35. The method of embodiment 34, further comprising urging a center axis of the tool to substantially align with a center axis of the internal bore of the tubular in response to applying the biasing forces to the outer surface of the tool and the inner surface of the internal bore of the tubular.

Embodiment 36. The method of embodiment 34, further comprising:

engaging the outer surface of the tool with the biasing devices; and engaging the inner surface of the internal bore of the tubular with the biasing devices.

Embodiment 37. The method of embodiment 34, further comprising:

electrically coupling the tool to the tubular via one or more of the biasing devices.

Embodiment 38. A system for a subterranean operation, the system comprising:

a centralizer configured to be radially positioned between a tool and an internal bore of a tubular, wherein the centralizer is configured to engage the internal bore and the tool via each one of a plurality of biasing devices disposed within a respective one of a plurality of protrusions circumferentially spaced away from each other about a center axis of the centralizer.

Embodiment 39. The system of embodiment 38, wherein at least one of the plurality of biasing devices is configured to electrically couple the tool to the tubular.

Embodiment 40. The system of embodiment 38, wherein the plurality of biasing devices are configured to urge a longitudinal center axis of the centralizer to be substantially aligned with a longitudinal center axis of the internal bore of the tubular.

Embodiment 41. The system of embodiment 38, wherein the plurality of biasing devices are configured to urge a longitudinal center axis of the tool to be substantially aligned with a longitudinal center axis of the centralizer.

Embodiment 42. The system of embodiment 38, wherein the centralizer further comprises a plurality of protrusions that extend radially out from a body of the centralizer and radially away from a center axis of the centralizer.

Embodiment 43. The system of embodiment 42, wherein the plurality of biasing devices comprise a first biasing device and a second biasing device, wherein the plurality of protrusions comprise a first protrusion and a second protrusion, and wherein the first biasing device is disposed in the first protrusion and the second biasing device is disposed in the second protrusion.

Embodiment 44. The system of embodiment 43, wherein the first biasing device comprises a first biasing element, and wherein the first biasing element is disposed within a first channel in the first protrusion, and wherein a first portion of the first biasing element extends radially inward from the first channel and a second portion of the first biasing element extends radially outward from the first channel.

Embodiment 45. The system of embodiment 44, wherein the first portion is configured to engage the tool when the tool is installed through a center bore of the centralizer, and wherein the second portion is configured to engage an inner surface of the internal bore of the tubular when the centralizer is installed in the internal bore of the tubular.

Embodiment 46. The system of embodiment 44, wherein the first channel comprises a varied profile that retains the first biasing element within the first channel and prevents the first biasing element from exiting the first channel from an inner radial end of the first protrusion.

Embodiment 47. The system of embodiment 44, wherein a first retention element is removably attached to an outer radial end of the first protrusion, such that the first biasing element is prevented from exiting the first channel through the outer radial end of the first protrusion.

Embodiment 48. The system of embodiment 38, wherein the centralizer comprises an insert with a plurality of protrusions extending radially outward from a central body, and wherein the central body comprises a central bore extending longitudinally through the central body along a center axis of the centralizer.

Embodiment 49. The system of embodiment 48, wherein the insert is positioned within a sleeve, and wherein the plurality of biasing devices extend radially outward through the sleeve.

Embodiment 50. The system of embodiment 48, wherein a first biasing element extends into the central bore and is configured to resiliently engage the tool, wherein a second biasing element extends radially outward from one of the plurality of protrusions and resiliently engages the internal bore of the tubular.

Embodiment 51. The system of embodiment 48, wherein a first biasing element extends into the central bore and is configured to resiliently engage the tool, and wherein the first biasing element extends radially outward from one of the plurality of protrusions and is configured to resiliently engage the internal bore of the tubular.

Embodiment 52. The system of embodiment 48, wherein a biasing element is disposed in an internal channel in each one of the plurality of protrusions, and wherein each one of the plurality of protrusions is circumferentially spaced away from an adjacent one of the plurality of protrusions by a substantially equal distance.

Embodiment 53. The system of embodiment 38, wherein the plurality of biasing devices are configured to dampen vibrations transmitted between the tubular and the tool.

Embodiment 54. A method of centralizing a tool within a tubular for a subterranean operation, the method comprising:

installing a biasing device in each one of a plurality of protrusions of a centralizer, wherein the plurality of protrusions extend radially outward from a body;

extending a first portion of each one of the biasing devices radially outward past an outer radial surface of a respective one of the plurality of protrusions, wherein the first portions are configured to engage an internal surface of a tubular; and extending a second portion of each one of the biasing devices radially inward past an inner radial surface of a central bore in the body of the centralizer, wherein the second portions are configured to engage an outer surface of a tool, and wherein the first portions and the second portions are configured to substantially align a center axis of the tool with a center axis of the tubular when the tool is installed in the tubular.

Embodiment 55. The method of embodiment 54, wherein the plurality of protrusions are circumferentially spaced away from each other about a center axis of the centralizer.

Embodiment 56. The method of embodiment 54, wherein the centralizer further comprises:

a sleeve; and an insert that comprises the plurality of protrusions, the body, and the central bore, wherein the method further comprises:

receiving the insert inside a bore of the sleeve; and installing a plurality of retention elements through the sleeve and engaging each one of the retention elements to a respective one of the plurality of the protrusions, thereby securing each one of the biasing devices in the respective one of the plurality of protrusions and securing the insert within the sleeve.

Embodiment 57. The method of embodiment 54, wherein at least one of the biasing devices is configured to electrically couple the tubular to the tool.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A method of centralizing a tool within a drill collar for a subterranean operation, the method comprising:

installing a biasing device in each one of a plurality of protrusions of a centralizer, wherein the plurality of protrusions extend radially outward from a body of the centralizer, wherein a central bore extends along a center axis of the body and is configured to receive the tool, and wherein the biasing devices are configured to engage the tool when the tool is installed in the central bore;

extending a first portion of each one of the biasing devices radially outward past an outer radial surface of a respective one of the plurality of protrusions, wherein the first portion of each one of the biasing devices is configured to engage an internal surface of the drill collar; and extending a second portion of each one of the biasing devices radially inward past an inner radial surface of the central bore, wherein the second portion of each one of the biasing devices is configured to engage an outer surface of the tool, and wherein the first and second portions of each one of the biasing devices are configured to substantially align a center axis of the tool with a center axis of the drill collar when the tool is installed in the drill collar.

2. The method of claim 1, wherein the plurality of protrusions are circumferentially spaced away from each other about a center axis of the centralizer.

3. The method of claim 1, wherein the biasing devices are configured to dampen vibrations that are received from either the drill collar or the tool.

4. The method of claim 1, wherein the biasing devices are configured to resiliently engage the drill collar and the tool.

5. The method of claim 1, wherein the centralizer further comprises:

a sleeve; and an insert that comprises the plurality of protrusions, the body, and the central bore.

6. The method of claim 5, wherein the insert is positioned within the sleeve, and wherein the biasing devices extend radially outward through the sleeve.

7. The method of claim 1, wherein the tool comprises a lower portion and an upper portion, with the upper portion electrically isolated from the lower portion, and wherein the drill collar comprises a lower segment and an upper segment, with the upper segment being electrically isolated from the lower segment, and wherein the centralizer is a first centralizer separate from a second centralizer.

8. The method of claim 7, further comprising:

electrically coupling, via the biasing devices of the first centralizer, the upper portion of the tool to the upper segment of the drill collar; and electrically coupling, via the biasing devices of the second centralizer, the lower portion of the tool and the lower segment of the drill collar.

9. The method of claim 8, further comprising:

varying a first voltage potential between the lower portion and the upper portion of the tool, and varying a second voltage potential between the lower segment and the upper segment of the drill collar in response to variations of the first voltage potential.

10. The method of claim 9, further comprising:

generating electromagnetic signals in response to variations in the second voltage potential; and transmitting the electromagnetic signals into an earthen formation.

11. A method of centralizing a tool within a tubular for a subterranean operation, the method comprising:

installing a biasing device in each one of a plurality of protrusions of a centralizer, wherein the plurality of protrusions extend radially outward from a body;

extending a first portion of each one of the biasing devices radially outward past an outer radial surface of a respective one of the plurality of protrusions, wherein the first portion of each one of the biasing devices is configured to engage an internal surface of the tubular; and extending a second portion of each one of the biasing devices radially inward past an inner radial surface of a central bore in the body of the centralizer, wherein the second portion of each one of the biasing devices is configured to engage an outer surface of the tool, and wherein the first portions and the second portions are configured to substantially align a center axis of the tool with a center axis of the tubular when the tool is installed in the tubular, wherein the centralizer further comprises:

a sleeve; and an insert that comprises the plurality of protrusions, the body, and the central bore, wherein the method further comprises:

receiving the insert inside a bore of the sleeve; and installing a plurality of retention elements through the sleeve and engaging each one of the retention elements to a respective one of the plurality of the protrusions, thereby securing each one of the biasing devices in the respective one of the plurality of protrusions and securing the insert within the sleeve.

* * * * *